US009994022B2

(12) United States Patent
Kajiwara et al.

(10) Patent No.: US 9,994,022 B2
(45) Date of Patent: Jun. 12, 2018

(54) RECORDING DEVICE, RECORDING METHOD, AND RECORDING UNIT

(71) Applicant: CANON KABUSHIKI KAISHA, Tokyo (JP)

(72) Inventors: Yuto Kajiwara, Kawasaki (JP); Akitoshi Yamada, Yokohama (JP); Okinori Tsuchiya, Yokohama (JP); Hiroyuki Sakai, Chigasaki (JP); Junichi Nakagawa, Tokyo (JP); Takeru Sasaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/623,244

(22) Filed: Jun. 14, 2017

(65) Prior Publication Data

US 2017/0361608 A1 Dec. 21, 2017

(30) Foreign Application Priority Data

Jun. 16, 2016 (JP) ..... 2016-120101

(51) Int. Cl.
*B41J 2/21* (2006.01)
*B41J 2/14* (2006.01)
*B41J 2/145* (2006.01)

(52) U.S. Cl.
CPC ..... *B41J 2/145* (2013.01); *B41J 2/2107* (2013.01)

(58) Field of Classification Search
CPC ..... B41J 2/2107; B41J 2/17566; B41J 2/145; B41J 2/1404
See application file for complete search history.

(56) References Cited

U.S. PATENT DOCUMENTS

2007/0024648 A1* 2/2007 Hirakawa ..... B41J 2/2114 347/6

FOREIGN PATENT DOCUMENTS

JP 10-44519 A 2/1998

OTHER PUBLICATIONS

"Method of Testing Liquid Absorbency of Paper and Paperboard;" Japan TAPPI paper pulp test method No. 51, pp. 1-10.

* cited by examiner

*Primary Examiner* — Thinh H Nguyen
(74) *Attorney, Agent, or Firm* — Canon U.S.A., Inc. IP Division

(57) ABSTRACT

A distance between a plurality of discharge orifice rows that discharge ink having a high permeation speed at a plurality of recording parts is made to be shorter than a distance between a plurality of discharge orifice rows that discharge ink having a low permeation speed at a plurality of recording parts.

18 Claims, 10 Drawing Sheets

RECORDING DEVICE, RECORDING METHOD, AND RECORDING UNIT

BACKGROUND OF THE INVENTION

Field of the Invention

One disclosed aspect of the embodiments relates to a recording device, a recording method, and a recording unit.

Description of the Related Art

There are known recording devices that record images by repeatedly executing recording scanning in which ink discharge is performed, where a recording unit that has a discharge port array in which multiple discharge orifices that discharge ink are arrayed, is relatively moved over an increment region of a recording medium. There has conventionally been demand for reduction in recording time on the recording medium regarding such recording devices. Japanese Patent Laid-Open No. 10-44519 describes using a recording unit, in which there are provided two recording parts, one to the left side and one to the right, in the scanning direction, to realize reduction in this recording time. Each recording part has multiple discharge orifice rows that discharge ink of multiple colors. Further described therein is discharging ink at the left side of the recording medium in the scanning direction only from the left-side recording part, and discharging ink at the right side of the recording medium in the scanning direction only from the right-side recording part. Accordingly, recording time can be reduced, since recording can be completed without the recording unit having to be scanned over the entire region from a position at the left edge portion of the recording medium to a corresponding position at the right edge portion of the recording medium.

Now, in a case of using the above-described recording unit to record the left and right sides of the recording medium in the scanning direction, using the respective left and right side recording parts, image quality at the boundary between the region recorded by the left-side recording part and the region recorded by the right-side recording part may deteriorate. In light of this point, Japanese Patent Laid-Open No. 10-44519 suppresses this deterioration in image quality by both the left-side recording part and the right-side recording part sharing recording of the middle portion in the scanning direction of the recording medium.

However, it has been found that, in a case of using a recording unit such as described above, with the recording part at one side and the recording part at the other side sharing recording of the middle portion in the scanning direction of the recording medium, the concentration of an image recorded at the middle portion by ink having fast permeation speed as to the recording medium may increase, depending on the array of discharge orifice rows within the recording unit.

FIG. 1A is a diagram schematically illustrating the process of ink fixing, when ink that has a low permeation speed as to the recording medium is applied twice to regions in proximity with a predetermined time difference therebetween. FIG. 1B is a diagram schematically illustrating the process of ink fixing, when ink that has a high permeation speed as to the recording medium is applied twice to regions in proximity with a predetermined time difference therebetween. In both FIGS. 1A and 1B, the circles represent color material contained in the ink applied at the earlier timing, and the triangles represent color material contained in the ink applied at the later timing.

When using an ink having a low permeation speed as illustrated in FIG. 1A, an earlier ink droplet 81 is applied from one of the recording parts at a timing T=T1, thereafter permeation of the ink to the recording medium 80 is not complete at a timing T=T3 where a later ink droplet 82 is applied from the other recording part, with solvent contained in the earlier ink droplet 81 still remaining near the surface of the recording medium 80. Due to this solvent remaining near the surface, the later ink droplet 82 applied at timing T=T3 cannot be fixed to the surface of the recording medium 80, and permeates into the recording medium avoiding the earlier ink droplet 81 at a timing T=T5. As a result, the color material is not concentrated near the surface of the recording medium 80 at timing T=T6, and can be fixed dispersed in the depth direction. It can thus be seen that in a case of using ink having a low permeation speed, deterioration in image quality does not readily occur even in a case where the time difference from applying ink to a certain region to applying ink later to the same region becomes somewhat longer.

On the other hand, in a case of using ink where the permeation speed as to the recording medium is fast, after an earlier ink droplet 83 being applied from one of the recording parts at a timing T=T1, permeation of the earlier ink droplet 83 to the recording medium 80 begins at a timing T=T2 before the timing T=T3 at which a later ink droplet 84 is applied from the other recording part, as illustrated in FIG. 1B. Accordingly, there is no solvent in the earlier ink droplet 83 remaining at timing T=T3 near the surface of the recording medium 80, and a gap is formed between the color material in the earlier ink droplet 83 that has been fixed near the surface of the recording medium 80. The color material in the later ink droplet 84 is capable of being fixed in this gap as well, after being applied at timing T=T3, so color material is concentrated near the surface of the recording medium at the boundary region of the earlier ink droplet 83 and the later ink droplet 84, after fixing indicated at timings T=T5 and T6. Thus, in a case of using ink with a fast permeation speed, discharging ink to a certain region and then applying ink to the same region after a certain time difference may result in the image concentration increasing.

Now, it is conceivable to apply the earlier ink droplet and later ink droplet of ink with a fast permeation speed, at timings with a short time difference, to where such an increase in image concentration will not occur. However, applying this timing to ink with a low permeation speed, the following situation occurs. That is to say, in a case where a discharge orifice row discharging ink with a high permeation speed and a discharge orifice row discharging ink with a low permeation speed have the same layout order in the scanning direction, the separation distance between one recording part and the other recording part needs to be shortened. Consequently, the distance over which the recording unit having the one recording part and the other recording part needs to be moved relatively as to the recording medium for a recording scan becomes long.

SUMMARY OF THE INVENTION

It has been found desirable to provide a recording device that is capable of suppressing deterioration in image quality without increasing relative movement distance of the recording unit as to the recording medium.

A recording device includes a recording unit, a scanning unit, and a recording control unit. The recording unit includes a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction, and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction. The first recording part and the second recording part are disposed separately from each other in an intersecting direction that intersects the predetermined direction. The scanning unit is configured to perform recording scanning by moving the recording unit in the intersecting direction. The recording control unit is configured to, in a same recording scan by the scanning unit, perform recording of a first region on the recording medium in the intersecting direction, including one edge of the recording medium, by only the first recording part, perform recording of a second region in the intersecting direction, including the other edge of the recording medium, by only the second recording part, and perform recording of a third region on the recording medium between the first region and the second region in the intersecting direction, by both the first recording part and the second recording part. The first ink has a higher permeation speed as to the recording medium than the permeation speed of the second ink as to the recording medium. A distance between the first discharge orifice row and the third discharge orifice row in the intersecting direction is a first distance, and a distance between the second discharge orifice row and the fourth discharge orifice row in the intersecting direction is a second distance that is longer than the first distance.

Further features of the disclosure will become apparent from the following description of exemplary embodiments with reference to the attached drawings.

DESCRIPTION OF THE EMBODIMENTS

First Embodiment

Figure 1A:
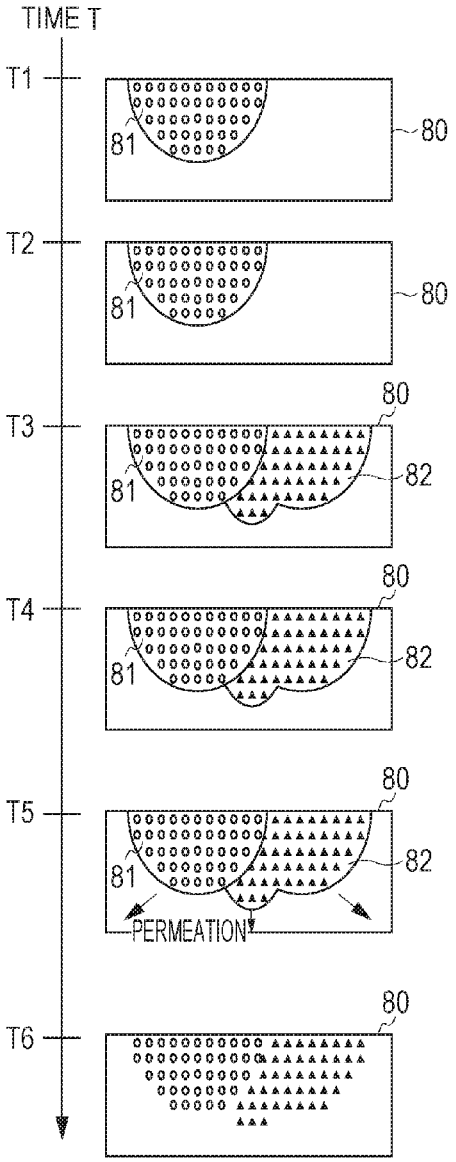
FIGS. 1A and 1B are schematic diagrams for describing increase in concentration due to permeation speed.
Figure 1B:
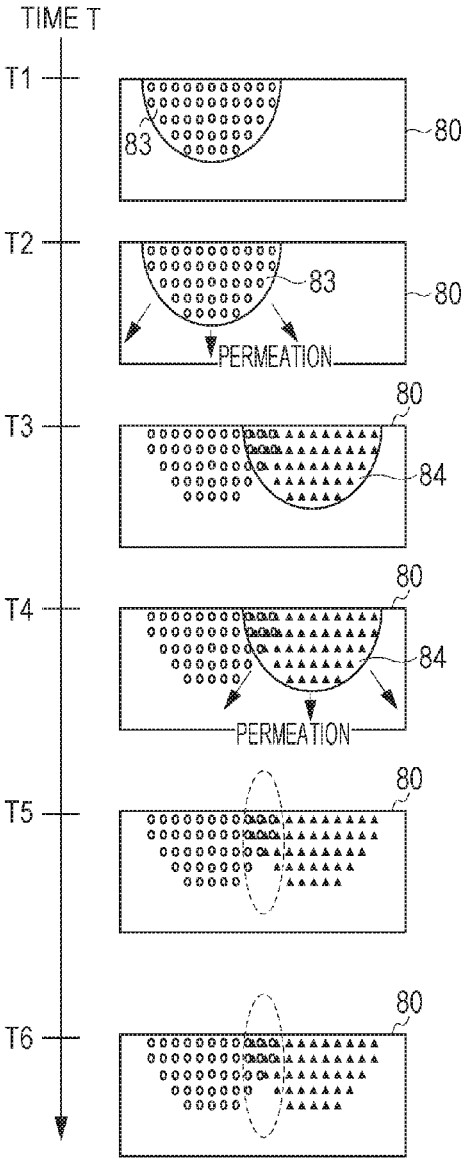
Figure 2:
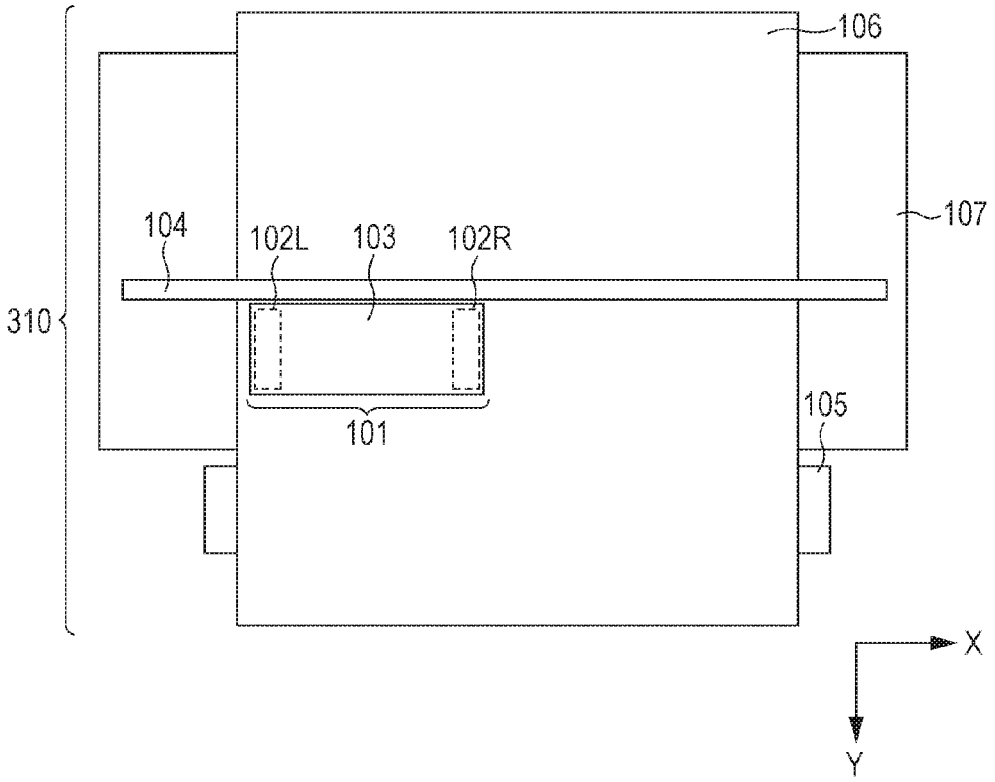
FIG. 2 is a schematic diagram illustrating the internal configuration of a recording device according to an embodiment.

A first embodiment will be described in detail below with reference to the drawings. FIG. 2 is a schematic diagram illustrating the internal configuration of an ink-jet recording device 310 according to an embodiment.

The ink-jet recording device (hereinafter also referred to as "printer" and "recording device") 310 according to the present embodiment has a recording unit 101. The recording unit 101 has a recording head 102L and a recording head 102R, the recording heads 102L and 102R being held by a single holding part 103. The recording heads 102L and 102R each have one discharge orifice row each for discharging black ink, cyan ink, magenta ink, and yellow ink, which will be described in detail later.

It can be seen from FIG. 2 that the recording heads 102L and 102R are at the same position in the Y direction and separated from each other in the X direction. Although the recording unit 101 is described here with the recording heads 102L and 102R being situated at the same position in the Y direction, this is not restrictive. The recording heads 102L and 102R may be provided at positions offset in the Y direction, as long as configured with a recording region corresponding to discharge orifice rows discharging ink of the respective colors partially overlapping in the Y direction, such that at least a partial region on the recording medium can be recorded by both of the recording heads 102L and 102R in the same scan.

The recording unit 101 is capable of reciprocally moving relative to the recording medium, in the X direction (intersecting direction) along a guide rail 104 provided extending in the X direction. The recording medium 106 is supported by a platen 107, and is conveyed in the Y direction (conveyance direction) by rotating a conveyance roller 105. The ink-jet recording device 310 according to the present embodiment completes recording on the entire region of the recording medium 106 by repeatedly performing recording operations where the recording unit 101 is scanned in the X direction, and conveyance operations of the recording medium 106 in the Y direction by the conveyance roller 105. Although a recording medium 106 having a pulp substrate with alumina or silica coated on the substrate is used in the present embodiment, any recording medium can be used as appropriate as long as it enables internal permeation of ink.

Figure 3:
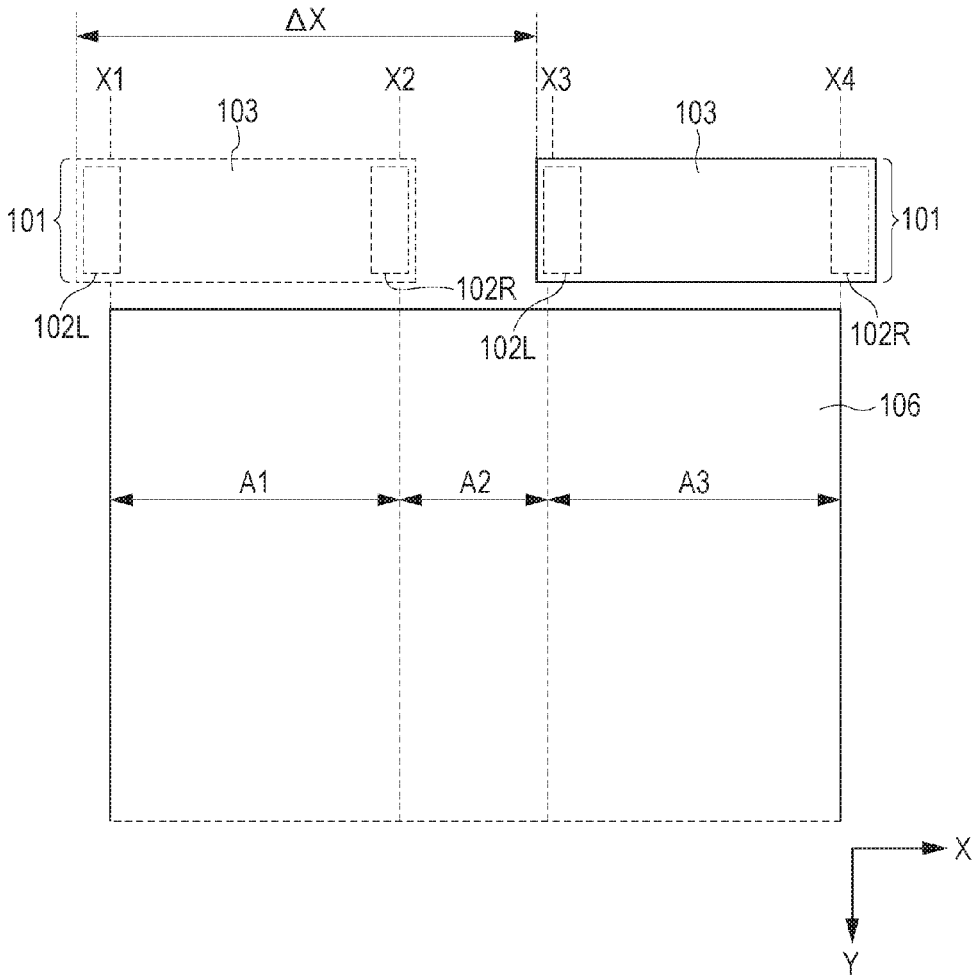
FIG. 3 is a diagram for describing a recording system according to an embodiment.

FIG. 3 is a schematic diagram for describing the way in which recording is performed on the recording medium 106 using the recording unit 101. Of the two recording units 101 illustrated in FIG. 3, the recording unit 101 situated at the left side in the X direction and drawn using dashed lines schematically illustrates the scan start position of the recording unit 101 when scanning the recording unit 101 from the left side toward the right side in the X direction, while the recording unit 101 situated at the right side in the X direction and drawn using solid lines schematically illustrates the scan end position of the recording unit 101.

The recording unit according to the present embodiment is scanned over a range from where the edge portion of the recording head 102L at the right side in the X direction is at a position facing an edge position X1 at the left edge of the recording medium 106 in the X direction, to the edge portion of the recording head 102R at the left side in the X direction is at a position facing an edge position X4 at the right edge of the recording medium 106 in the X direction. The recording unit 101 can be scanned over this range by the recording unit 101 being moved by a distance ΔX. Thus, according to the present embodiment, the recording unit does not have to be moved over the entire region from one edge of the recording medium in the X direction to the other edge as in conventional arrangements, so recording can be performed with reduced recording time.

Hereinafter, a position on the recording medium in the X direction that the edge portion of the recording head 102R at the right side in the X direction faces when the edge portion of the recording head 102L at the right side in the X direction faces the edge position X1 of the recording medium 106 will be described as position X2, and a position on the recording medium in the X direction that the edge portion of the recording head 102L at the left side in the X direction faces when the edge portion of the recording head 102R at the left side in the X direction faces the edge position X4 of the recording medium 106 will be described as position X3. Further, in the following description, a region on the recording medium from position X1 to position X2, which is a region to the left side in the X direction, will be referred to as region A1. A region on the recording medium from position X2 to position X3, which is a region at the middle in the X direction, will be referred to as region A2. A region on the recording medium from position X3 to position X4, which is a region to the right side in the X direction, will be referred to as region A3.

In a case of scanning the recording unit 101 over the ranges such as described above, the recording head 102R does not discharge ink to the region A1 of the recording medium to the left side of position X2 in the X direction. The reason is that position X2 is where the right edge of the recording head 102R in the X direction faces the region A1, so ink cannot be discharged from some of the discharge orifice rows within the recording head 102R to region A1. That is to say, the region A1 at the left side of the recording medium in the X direction is a region where recording is performed only by the recording head 102L. On the other hand, regarding region A3 at the right side of the recording medium in the X direction, position X3 is where the left edge of the recording head 102L in the X direction faces the region A3, so ink is not discharged from the recording head 102L to region A3, and recording is performed only by the recording head 102R.

In contrast to this, ink can be discharge from both the recording head 102L and recording head 102R to the region A2 at the middle of the recording medium in the X direction. Accordingly, data corresponding to the region A2 is divided by performing later-described recording head distribution processing in the present embodiment, and shared recording of the region A2 is performed using both the recording head 102R and recording head 102L.

As described above, the recording medium 106 is divided into three in the X direction in the present embodiment, with the three regions of region A1, region A2 that is adjacent to region A1 in the X direction, and region A3 that is adjacent to region A2 in the X direction, are recorded differently by the recording heads. Specifically, region A1 at the left side in the X direction is recorded by the recording head 102L alone, region A3 at the right side in the X direction is recorded by the recording head 102R alone, and region A2 at the middle in the X direction is recorded by both recording heads 102L and 102R discharging ink.

Figure 4:
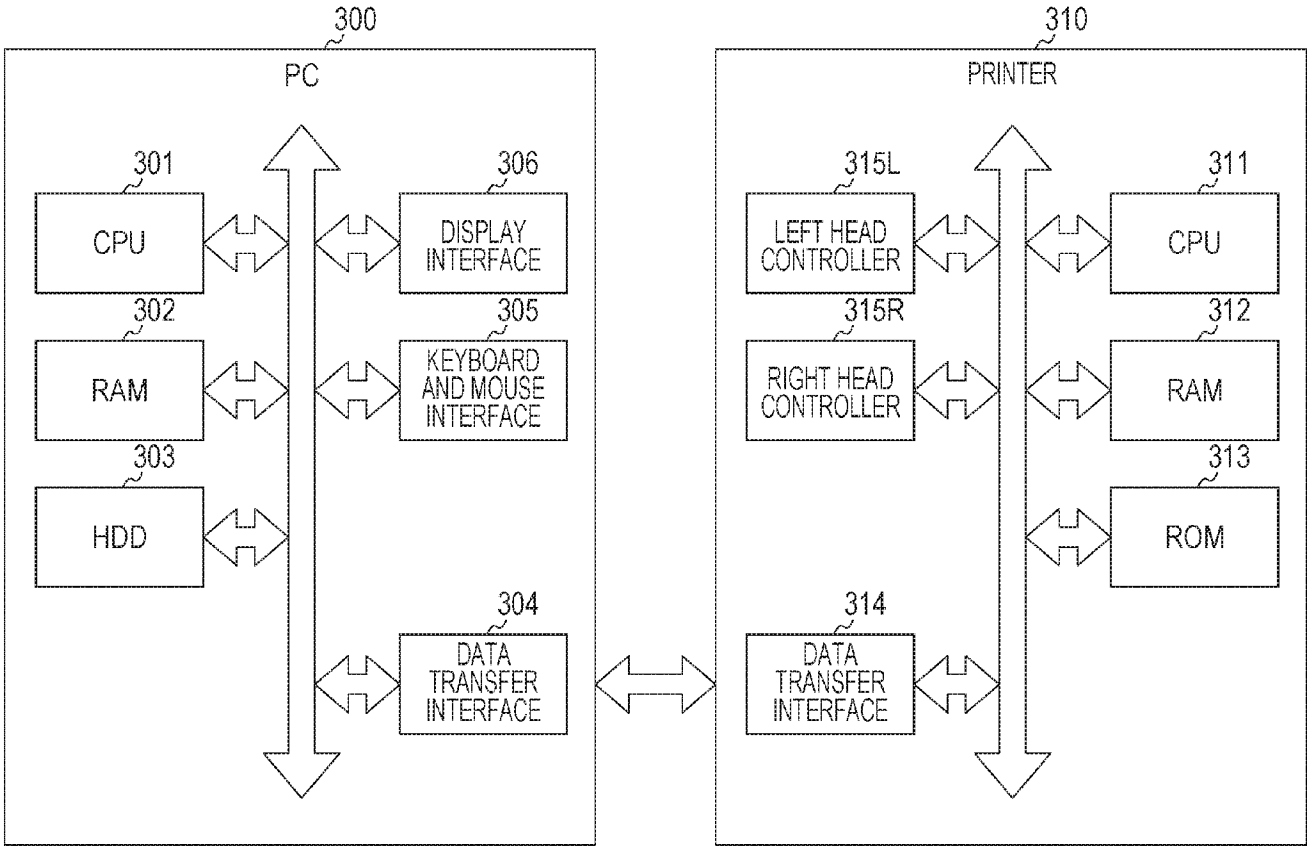
FIG. 4 is a diagram for describing a recording control system according to an embodiment.

FIG. 4 is a block diagram illustrating a schematic configuration of a recording control system according to the present embodiment. The recording control system according to the present embodiment is made up of the printer 310 illustrated in FIG. 2, and a personal computer (hereinafter "PC") 300 serving as a host device thereof.

The PC 300 is configured having the following components. A central processing unit (CPU) 301 executes processing following programs held in random access memory (RAM) 302 or a hard disk drive (HDD) 303 serving as storage. The RAM 302 is volatile memory, and temporarily stores programs and data. The HDD 303 is nonvolatile memory, and also stores programs and data. A data transfer interface 304 controls exchange of data with the printer 310 in the present embodiment. Examples of connection standards that can be used for this data exchange include USB, IEEE 1394, and IEEE 802. A keyboard and mouse interface 305 is an interface that controls human interface devices (HIDs) such as keyboards, mice, etc., by which the user can perform input. A display interface 306 controls display performed at a display unit (omitted from illustration).

On the other hand, the printer 310 is configured having the following components. A CPU 311 executes later-described processing following programs held in RAM 312 or read-only memory (ROM) 313. The RAM 312 is volatile memory, and temporarily stores programs and data. The ROM 313 is nonvolatile memory, and can store table data and programs used in later-described processing. A data transfer interface 314 controls exchange of data with the PC 300.

A left head controller 315L and a right head controller 315R respectively supply recording data to the recording head 102L and recording head 102R illustrated in FIG. 2, and also control discharge operations of each of the recording heads 102L and 102R (discharge control). Specifically, the left head controller 315L may have a configuration of reading control parameters and recording data from a predetermined address of the RAM 312. Upon the CPU 311 writing control parameters and recording data to this predetermined address of the RAM 312, processing is activated by the left head controller 315L, and ink discharge is performed from the recording head 102L. This is the same regarding the right head controller 315R, in when the CPU 311 writes control parameters and recording data to a predetermined address of the RAM 312, processing is activated by the right head controller 315R, and ink discharge is performed from the recording head 102R.

Data Processing Procedures

Figure 5:
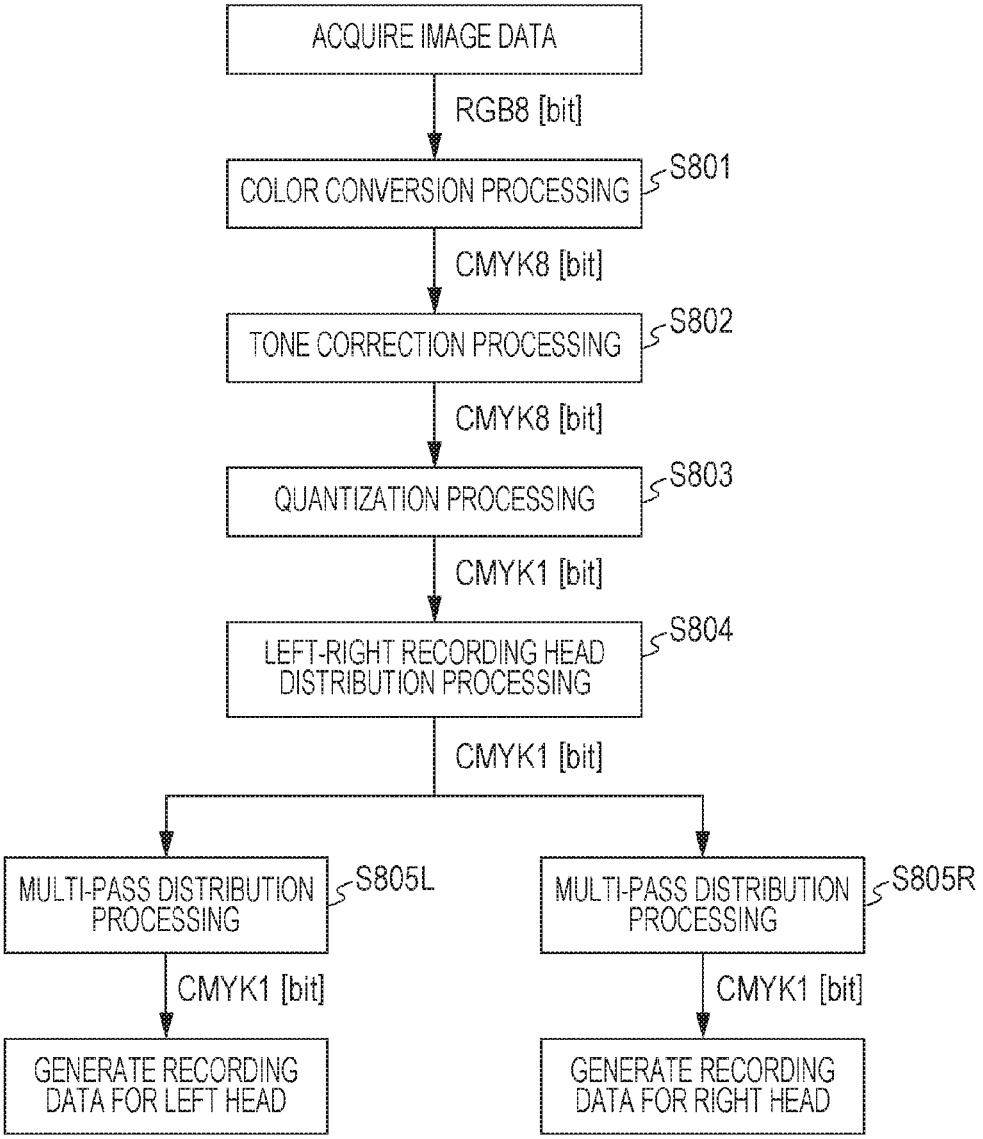
FIG. 5 is a flowchart illustrating procedures of image processing according to an embodiment.

FIG. 5 is a flowchart of processing for generating recording data used for recording, executed by the CPU 311 following a control program according to the present embodiment. Note that this control program is stored in the ROM 313 beforehand.

When RGB data in RGB format is acquired at the recording device 310 from the PC 300, color conversion processing is first performed in step S801, to convert the RGB data into ink color data corresponding to the colors of inks used for recording. This color conversion processing generates ink color data represented in 8-bit 256-color information that sets the tone value for each of multiple pixels. The present embodiment uses black ink, cyan ink, magenta ink, and yellow ink in the present embodiment as described above, so ink color data is generated by color conversion processing in step S801 that corresponds to each of the black ink, cyan ink, magenta ink, and yellow ink. Different processing may be executed as appropriate for the color conversion processing, or a three-dimensional look-up table (3D-LUT) stipulating the correspondence between RGB values and CMYK values that is stored in the ROM 313 beforehand for example, or further, tetrahedral interpolation may be performed.

Next, in step S802, tone correction processing where tone values indicated by ink color data for each of the CMYK values are corrected, and tone correction data where the CMYK values are expressed in the form of 8-bit 256-color information is generated. A one-dimensional look-up table (1D-LUT), stipulating the correspondence between ink color data corresponding to each color ink before correction and tone correction data corresponding to each color ink after correction, or the like, may be used in this tone correction processing, for example. Note that the 1D-LUT is stored in the ROM 313 beforehand.

In step S803, quantization processing is performed where the tone correction data is quantized, and quantization data (image data) expressed in the form of 1-bit binary information, setting discharge/non-discharge of ink for each color corresponding to each pixel, is generated. Various conventionally-known types of processing, such as error diffusion, dithering, etc., may be applied to the quantization processing.

Next, in step S804, distribution processing is performed where, of the quantization data corresponding to each ink color, and quantization data corresponding to the region A2 where shared recording is to be performed, is distributed to the recording head 102L and recording head 102R. Further, the logical sum is obtained in this distribution processing for quantization data distributed to the recording head 102L and quantization data corresponding to the region A1 on the recording medium, thereby generating distribution data corresponding to the recording head 102L, in which is set discharge/non-discharge of ink of each color from the recording head 102L as to the recording medium, regarding each pixel. In the same way, the logical sum is obtained for quantization data distributed to the recording head 102R and quantization data corresponding to the region A3 on the recording medium, thereby generating distribution data corresponding to the recording head 102R, in which is set discharge/non-discharge of ink of each color from the recording head 102R as to the recording medium, regarding each pixel. This left-right recording head distribution processing will be described later.

Then in step S805L, the distribution data corresponding to the recording head 102L is distributed to multiple scans (passes) performed over the same unit region on the recording medium, and recording data for the recording head 102L, used for discharging ink from the recording head 102L in each of the multiple scans, is generated. In the same way, in step S805R, the distribution data corresponding to the recording head 102L is distributed to multiple scans, and recording data for the recording head 102R, used for discharging ink from the recording head 102R in each of the multiple scans, is generated. Discharging operations for discharging from the recording heads 102L and 102R are executed according to the recording data for the recording heads 102L and 102R generated in steps S805L and S805R. Note that the processing in steps S805L and S805R can be carried out by using multiple mask patterns having layouts of recording-permitted pixels regarding which recording is permitted, and recording-non-permitted pixels regarding which recording is not permitted, corresponding to multiple scans, for example. These multiple mask patterns are stored in the ROM 313 beforehand.

Although an arrangement where multiple scans are performed as to one unit region has been described, a unit region may be scanned just once. In this case, the processing in steps S805L and S805R can be omitted. Also, although an arrangement has been described here where the CPU 311 in the printer 310 performs all of the processing from step S801 through steps S805L and S805R, the CPU 301 in the PC 300 may perform part or all of the processing from step S801 through steps S805L and S805R.

Figure 6A:
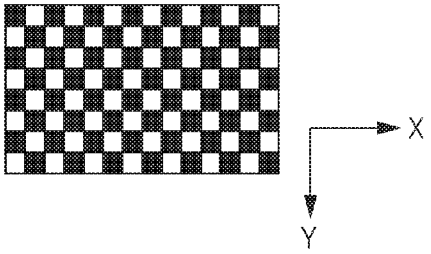
FIGS. 6A through 6C are diagrams for describing left-right head distribution processing according to an embodiment.
Figure 6B:
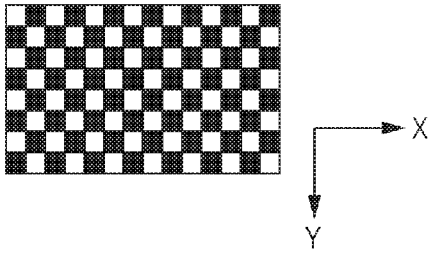
Figure 6C:
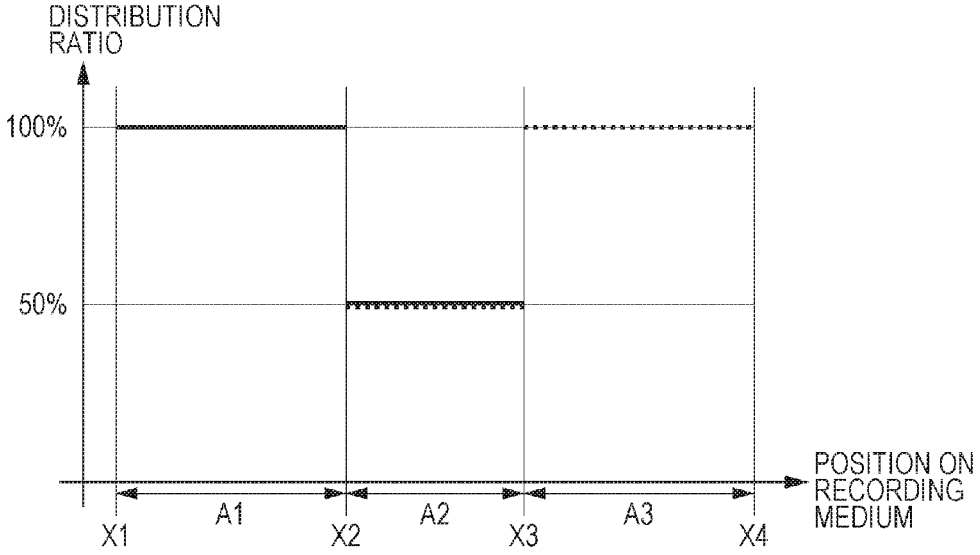

FIGS. 6A through 6C are schematic diagrams illustrating an example of distribution patterns used in the left-right head distribution processing in step S804 in the present embodiment. FIG. 6A is a diagram schematically illustrating a distribution pattern for distributing quantization data, corresponding to region A2 on the recording medium, to the recording head 102L. FIG. 6B is a diagram schematically illustrating a distribution pattern for distributing quantization data, corresponding to region A2 on the recording medium, to the recording head 102R. Note that these distribution patterns are stored in the ROM 313 beforehand.

FIG. 6C is a diagram illustrating the distribution ratio to the recording head 102L, stipulated by the ratio of quantization data distributed to the recording head 102L, and the distribution ratio to the recording head 102R, stipulated by the ratio of quantization data distributed to the recording head 102R. The solid lines in FIG. 6C represent the distribution ratio to the recording head 102L, and the dashed lines represent the distribution ratio to the recording head 102R.

To simplify explanation here, description will be made regarding an arrangement where the region A2 has a size of 14 pixels in the X direction. Accordingly, the distribution patterns illustrated in FIGS. 6A and 6B, corresponding to recording heads 102L and 102R, also have a size of 14 pixels in the X direction. The distribution patterns illustrated in FIGS. 6A and 6B are configured with an 8-pixel size in the Y direction as a repetition unit, and the left-right head distribution processing is completed as to the entirety of the region A2, by repeatedly using these distribution patterns in the Y direction. In the distribution patterns illustrated in FIGS. 6A and 6B, the black pixels indicate pixels regarding which discharging of ink is permitted in a case where ink discharge is set by the quantization data. On the other hand, the white pixels indicate pixels regarding which discharging of ink is not permitted, even in a case where ink discharge is set by the quantization data.

It can be seen from FIGS. 6A and 6B that the distribution pattern corresponding to the discharge orifice row provided to the recording head 102L used in the present embodiment, and the distribution pattern corresponding to the discharge orifice row provided to the recording head 102R have ink discharge permitted at mutually exclusive and complementary positions. Accordingly, left-right head distribution processing can be performed so that in a case where quantization data instructing discharge of ink to all pixels is acquired as the quantization data corresponding to the region A2, for example, ink is discharged just once, from either one or the other of the recording head 102L and the recording head 102R, at all pixels within this region A2.

Further, it can be seen from FIGS. 6A and 6B that the distribution pattern corresponding to the discharge orifice row in the recording head 102L and the distribution pattern corresponding to the discharge orifice row in the recording head 102R, used in the present embodiment, each have half of the total number of pixels permitted to discharge ink, regardless of the position in the X direction on the recording medium. Accordingly, in a case of using the distribution patterns illustrated in FIGS. 6A and 6B, the distribution ratio over the entire region of the recording medium in the X direction is as illustrated in FIG. 6C. That is to say, no quantization data corresponding to region A1 is distributed to the recording head 102R, so the distribution ratio to the recording head 102L in region A1 is 100%. Similarly, no quantization data corresponding to region A3 is distributed to the recording head 102L, so the distribution ratio to the recording head 102R in region A3 is 100%. On the other hand, the distribution patterns illustrated in FIGS. 6A and 6B are both set to discharge ink from half of the pixels, regardless of the position in the X direction, so the distribution ratio is 50% to the recording head 102L and 50% to the recording head 102R in the region A2, regardless of the position in the X direction.

Thus, the total of the distribution ratio to the recording head 102L and the recording head 102R is 100% in each of the regions A1, A2, and A3 on the recording medium, by using the distribution patterns illustrated in FIGS. 6A and 6B. That is to say, even though quantization data is distributed to the recording head 102L and recording head 102R, and shared recording of the region A2 is performed by the recording head 102L and recording head 102R, the discharge amount of ink as to the region A2 is not greatly different from the discharge amount desirable for the regions A1 and A3.

The data processing procedures such as described above are used in the present embodiment to generate recording data used for recording based on acquired RGB data, and to control ink discharge from the recording unit 101 following the recording data.

Composition of Ink

The compositions of the cyan ink, magenta ink, yellow ink, and black ink, used in the present embodiment, will each be described in detail. Note that in the following description, "parts" and "%" are to be understood to be "parts by mass" and "% by mass", unless specifically stated otherwise.

1. Cyan Ink

The cyan ink used in the present embodiment contains C.I. Direct Blue 199, which is a dye, as a color material. Specifically, the cyan ink used in the present embodiment is prepared by blending and agitating the following components, followed by filtration under pressure using a micro-filter.

| | |
|---|---|
| C.I. Direct Blue 199 | 3% |
| Diethylene Glycol | 10% |
| Isopropyl Alcohol | 2% |
| Urea | 5% |
| Acetylenol EH (Manufactured by Kawaken Fine Chemicals Co., Ltd.) | 1% |
| Ion-exchanged water | 79% |

2. Magenta Ink

The magenta ink used in the present embodiment contains C.I. Acid Red 289, which is a dye, as a color material. Specifically, the magenta ink used in the present embodiment is prepared by blending and agitating the following components, followed by filtration under pressure using a micro-filter.

| | |
|---|---|
| C.I. Acid Red 289 | 3% |
| Diethylene Glycol | 10% |
| Isopropyl Alcohol | 2% |
| Urea | 5% |
| Acetylenol EH (Manufactured by Kawaken Fine Chemicals Co., Ltd.) | 1% |
| Ion-exchanged water | 79% |

3. Yellow Ink

The yellow ink used in the present embodiment contains C.I. Direct Yellow 86, which is a dye, as a color material. Specifically, the yellow ink used in the present embodiment is prepared by blending and agitating the following components, followed by filtration under pressure using a micro-filter.

| | |
|---|---|
| C.I. Direct Yellow 86 | 3% |
| Diethylene Glycol | 10% |
| Isopropyl Alcohol | 2% |
| Urea | 5% |
| Acetylenol EH (Manufactured by Kawaken Fine Chemicals Co., Ltd.) | 1% |
| Ion-exchanged water | 79% |

4. Black Ink

The black ink used in the present embodiment contains C.I. Direct Black 154, which is a dye, as a color material. Specifically, the black ink used in the present embodiment is prepared by blending and agitating the following components, followed by filtration under pressure using a micro-filter.

| | |
|---|---|
| C.I. Direct Black 154 | 3% |
| Diethylene Glycol | 10% |
| Isopropyl Alcohol | 2% |
| Urea | 5% |
| Ion-exchanged water | 80% |

It can be seen from the above that of the inks used in the present embodiment, the cyan ink, magenta ink, and yellow ink, which are color ink, contain acetylenol EH. On the other hand, the black ink does not contain acetylenol EH.

Now, acetylenol EH is a type of acetylene glycol surfactant, and aids in improving the permeability of ink. The fixability of color ink according to the present embodiment as to the recording embodiment is improved by containing acetylenol EH, which improves permeability as to the recording medium and speeds up the permeation speed.

On the other hand, in a case where the permeation speed of ink is increased, a phenomenon may occur where the ink spreads following fibers of the recording medium after having been deposited thereupon. This phenomenon leads to so-called "feathering", where ink spreads on the recording medium. Feathering particularly leads to poor image quality in the case of recording character images and fine-line images. Accordingly, since black ink is often used in recording character images and fine-line images, the black ink according to the present embodiment does not contain acetylenol EH, thereby suppressing occurrence of feathering by keeping the permeability low.

Although acetylenol EH is included in the present embodiment to increase the permeation speed of the color ink, other acetylenic glycol surfactants may be used. Usage of acetylenic glycol surfactants is not restrictive, and various surfactants can be used, such as anionic surfactants, non-ionic surfactants, fluorinated surfactants, silicone surfactants, and so forth. Further, other permeation enhancers such as alcohol or the like may be used besides surfactants.

Recording in the present embodiment is performed using inks having different permeability, as described above. An example of a technique for evaluating permeability of ink to a recording medium will be described. The Bristow's method, described in "Method of Testing Liquid Absorbency of Paper and Paperboard" in Japan TAPPI paper pulp test method No. 51, is commonly known as a technique for evaluating permeability of ink.

In the Bristow's method, a predetermined amount of ink is placed in a holding container having an opening slit of a predetermined size, a recording medium that has been strips and wound onto a disc is brought into contact therewith, the disc is rotated with the position of the holding container fixed, and the area (length) of a band of ink transferred to the recording medium is measured. The amount of transfer per second per unit area ($ml \cdot m^2$) is calculated from the area of this ink band, and a Ka value ($ml \cdot m^2 \cdot ms^{1/2}$) that is an absorption coefficient of ink as to the recording medium is calculated, based on the amount of transfer. The higher the Ka value calculated in this way is, the higher the permeability of the ink as to the recording medium is, meaning that the permeation speed is faster. For example, Expression (1) indicates the relationship between Ka values calculated by the Bristow's method for the inks used in the present embodiment.

$$Ka \text{ value of black ink} < Ka \text{ value of color ink} \quad \text{Expression (1)}$$

Although an arrangement where the Ka value calculated by the Bristow's method is used to evaluate the permeability of ink has been described. Other parameters may be used as well. For example, permeability may be evaluated using surface tension (mN/m). Generally, the lower the surface tension is, the higher the permeability is. That is to say, the surface tensions of the inks used in the present embodiment are in the relationship indicated by Expression (2).

$$\text{surface tension of black ink} > \text{surface tension of color ink} \quad \text{Expression (2)}$$

Details of Recording Unit 101

As described earlier, in a case of using ink that has a high permeation speed as to the recording medium, the concentration of the image may increase if ink is applied to a certain region on the recording medium at an earlier timing and then applying ink to the same region on the recording medium after a relatively long amount of time has elapsed. Accordingly, in a case of using a recording unit having two recording heads 102L and 102R such as illustrated in FIGS. 2 and 3, the discharge orifice rows in the recording head 102L that discharge ink with a high permeation speed and the discharge orifice rows in the recording head 102R that discharge ink with a high permeation speed are preferably situated closer together in the X direction, to minimize the above-described time difference.

On the other hand, reducing the length of the holding part 103 in the X direction to reduce the distance between the recording head 102L and recording head 102R increases the scanning range of the recording unit to record the entire region of the recording medium in a single scan, which can lead to longer recording time. Accordingly, from the perspective of reduction in recording time, the recording unit preferably is provided such that the recording head 102L and the recording head 102R are maximally separated in the X direction.

In light of the above, the layout of the discharge orifice rows in the recording heads 102L that discharge multiple types of ink and the discharge orifice rows in the recording heads 102R that discharge multiple types of ink is decided such that both increase in concentration due to the above-described permeation speed, and longer recording time, are suppressed. Specifically, a recording unit 101 is used in the present embodiment where the distance in the X direction between discharge orifice rows in the recording heads 102L and 102R that discharge ink of which the permeation speed is high is shorter than the distance in the X direction between discharge orifice rows in the recording heads 102L and 102R that discharge ink of which the permeation speed is low.

Figure 7A:
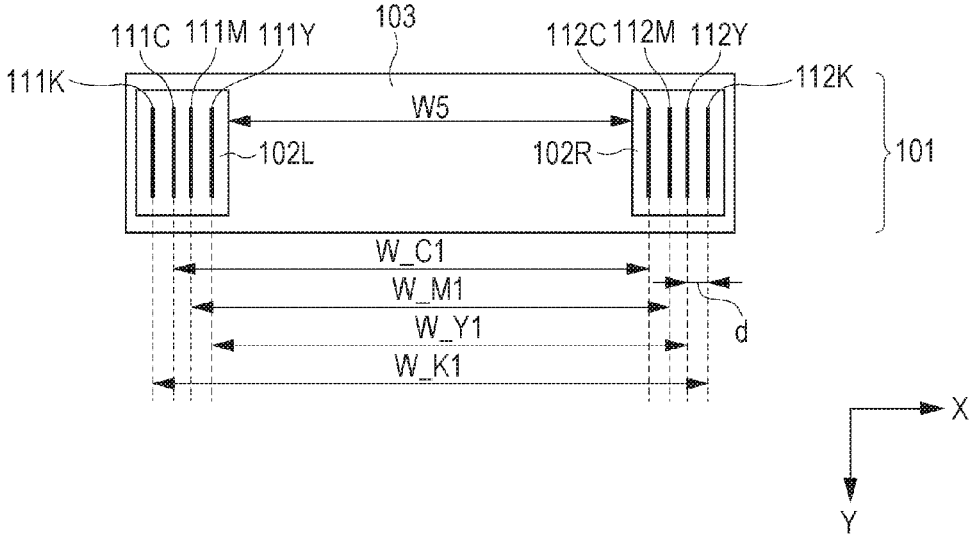
FIGS. 7A and 7B are diagrams illustrating a record unit used in an embodiment in detail.
Figure 7B:
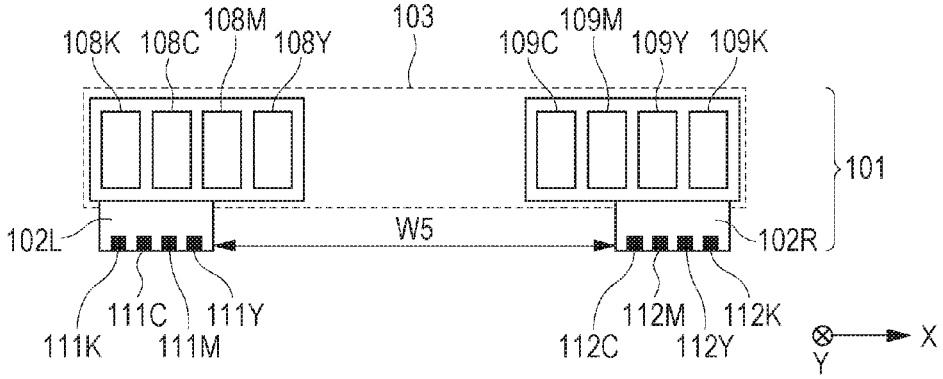

FIGS. 7A and 7B are diagrams illustrating the recording unit 101 used in the present embodiment in detail. FIG. 7A schematically illustrates the recording unit 101 from below in the vertical direction as to the XY plane. FIG. 7B schematically illustrates the recording unit 101 as viewed from the Y direction.

The recording head 102L and the recording head 102R in the recording unit 101 according to the present embodiment are separated by a distance W5 in the X direction. The recording head 102L has four discharge orifice rows 111C, 111M, 111Y, and 111K, in the order of discharge orifice row 111K that discharges black ink, discharge orifice row 111C that discharges cyan ink, discharge orifice row 111M that discharges magenta ink, and discharge orifice row 111Y that discharges yellow ink, from the left side in the X direction. On the other hand, the recording head 102R has four discharge orifice rows 112C, 112M, 112Y, and 112K, in the order of discharge orifice row 112C that discharges cyan ink, discharge orifice row 112M that discharges magenta ink, discharge orifice row 112Y that discharges yellow ink, and discharge orifice row 112K that discharges black ink, from the left side in the X direction.

Note that the four discharge orifice rows 111C, 111M, 111Y, and 111K in the recording head 102L are laid out separated from each other by a same distance d. In the same way, the four discharge orifice rows 112C, 112M, 112Y, and 112K in the recording head 102R are laid out separated from each other by the same distance d. The eight discharge orifice rows each have multiple discharge orifices (omitted from illustration) that discharge ink, arrayed in the Y direction (predetermined direction).

The discharge orifices within each discharge orifice row in the recording head 102L are connected to an ink tank accommodating the respective ink, via channels omitted from illustration. In detail, the discharge orifices arrayed in the discharge orifice row 111C are connected to an ink tank 108C accommodating cyan ink, the discharge orifices arrayed in the discharge orifice row 111M are connected to an ink tank 108M accommodating magenta ink, the discharge orifices arrayed in the discharge orifice row 111Y are connected to an ink tank 108Y accommodating yellow ink, and the discharge orifices arrayed in the discharge orifice row 111K are connected to an ink tank 108K accommodating black ink. In the same way, in the recording head 102R the discharge orifices arrayed in the discharge orifice row 112C are connected to an ink tank 109C accommodating cyan ink, the discharge orifices arrayed in the discharge orifice row 112M are connected to an ink tank 109M accommodating magenta ink, the discharge orifices arrayed in the discharge orifice row 112Y are connected to an ink tank 109Y accommodating yellow ink, and the discharge orifices arrayed in the discharge orifice row 112K are connected to an ink tank 109K accommodating black ink.

Although an arrangement has been described here where the discharge orifice rows in the recording head 102L and the discharge orifice rows in the recording head 102R that discharge ink of the same color are connected to different ink tanks, discharge orifice rows that discharge ink of the same color may be connected to the same single tank. Regardless of whether different ink tanks are used or the same ink tank is used, providing the ink tank(s) at the middle of the holding part 103 in the X direction enables the recording unit 101 to be reduced in size. However, if reduction in size is not an issue, and two different ink tanks are to be used, a design may be made where the middle portions of the respective recording heads and the ink tanks in the X direction generally agree, for example.

Now, the distance in the X direction between two discharge orifice rows that discharge ink of the same color in the present embodiment will be described for each of the colors. In order to simplify description, the width in the X direction of the discharge orifice rows, and the width in the X direction of regions at the edges within the recording heads where no discharge orifice rows are formed, will be disregarded.

First, with regard to the cyan ink, the discharge orifice row 111C is situated the third from the right side in the X direction within the recording head 102L, and the discharge orifice row 112C is situated the first from the left side in the X direction within the recording head 102R. Accordingly, distance W_C1 in the X direction between the discharge orifice row 111C and discharge orifice row 112C is a distance that can be calculated by Expression (3-1).

$$W_C1=W5+2\times d+0\times d=W5+2d \quad \text{Expression (3-1)}$$

Now, the term "2×d" in Expression (3-1) is a term corresponding to the fact that there are two discharge orifice rows to the right of the discharge orifice row 111C in the X direction within the recording head 102L. The term "0×d" in Expression (3-1) is a term corresponding to the fact that there are no discharge orifice rows to the left of the discharge orifice row 112C in the X direction within the recording head 102R.

In the same way, with regard to the magenta ink, the discharge orifice row 111M is situated the second from the right side in the X direction within the recording head 102L, and the discharge orifice row 112M is situated the second from the left side in the X direction within the recording head 102R. Accordingly, distance W_M1 in the X direction between the discharge orifice row 111M and discharge orifice row 112M is a distance that can be calculated by Expression (3-2).

$$W_M1=W5+1\times d+1\times d=W5+2d \quad \text{Expression (3-2)}$$

Also, with regard to the yellow ink, the discharge orifice row 111Y is situated the first from the right side in the X direction within the recording head 102L, and the discharge orifice row 112Y is situated the third from the left side in the X direction within the recording head 102R. Accordingly, distance W_Y1 in the X direction between the discharge orifice row 111Y and discharge orifice row 112Y is a distance that can be calculated by Expression (3-3).

$$W_Y1=W5+0\times d+2\times d=W5+2d \quad \text{Expression (3-3)}$$

Further, with regard to the black ink, the discharge orifice row 111K is situated the fourth from the right side in the X direction within the recording head 102L, and the discharge orifice row 112K is situated the fourth from the left side in the X direction within the recording head 102R. Accordingly, distance W_K1 in the X direction between the discharge orifice row 111K and discharge orifice row 112K is a distance that can be calculated by Expression (3-4).

$$W_K1=W5+3\times d+3\times d=W5+6d \quad \text{Expression (3-4)}$$

It can thus be seen from Expressions (3-1), (3-2), (3-3), and (3-4), that in the recording unit 101 used in the present embodiment, the discharge orifice rows are arranged such that the distance W_C1 between the discharge orifice rows 111C and 112C that discharge cyan ink, the distance W_M1 between the discharge orifice rows 111M and 112M that discharge magenta ink, and the distance W_Y1 between the discharge orifice rows 111Y and 112Y that discharge yellow ink, which are all (W5+2d), is shorter than the distance W_K1 (W5+6d) between the discharge orifice rows 111K and 112K that discharge black ink.

As described above, the ink used in the present embodiment is prepared such that the permeation speed of the cyan ink, magenta ink, and yellow ink, as to the recording medium, is higher than the permeation speed of the black ink. That is to say, the black ink has a lower permeation speed, so there is not increase in concentration even if applied twice to the same region with a certain amount of time difference in between. Accordingly, the recording unit 101 is provided such that the distance W_K1 between the discharge orifice rows 111K and 112K that discharge black ink is long in the present embodiment, as calculated from the above Expression (3-4).

On the other hand, the permeation speed of the cyan ink, magenta ink, and yellow ink is high, so there may be increase in concentration if applied twice to the same region with a certain amount of time difference in between. Accordingly, the recording unit 101 used in the present embodiment is provided such that the distance W_C1 between the discharge orifice rows 111C and 112C discharging cyan ink, the distance W_M1 between the discharge orifice rows 111M and 112M discharging magenta ink, and the distance W_Y1 between the discharge orifice rows 111Y and 112Y discharging yellow ink, is short, as calculated from the above Expressions (3-1), (3-2), and (3-3).

As described above, the multiple discharge orifice rows for the multiple types of ink are arrayed in the multiple recording heads such that the distance between discharge orifice rows discharging ink of which the permeation speed is high, is shorter than the distance between discharge orifice rows discharging ink of which the permeation speed is low, in the recording unit according to the present embodiment. Thus, recording can be performed with reduced recording time, while suppressed increased concentration in the color ink of which the permeation speed is high.

Figure 8A:
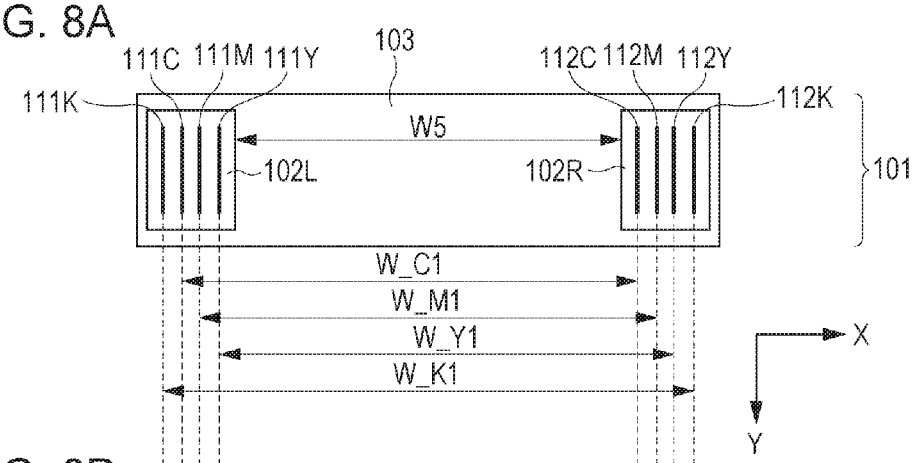
FIGS. 8A through 8C are diagrams illustrating recording units used in an embodiment and in comparative examples.
Figure 8B:
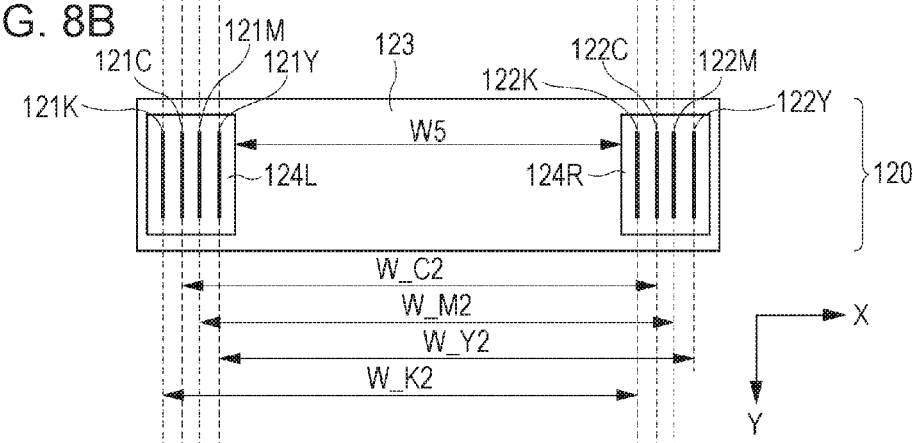
Figure 8C:
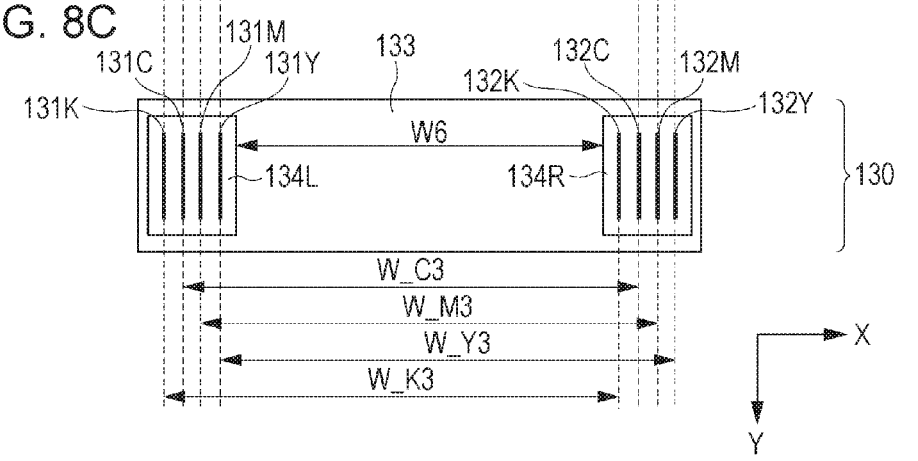

Next, a mechanism whereby increased concentration due to permeation speed and longer recording time can be suppressed, by using the recording unit according to the present embodiment, will be described by referencing two comparative embodiments and comparing these comparative embodiments with the recording unit according to the present embodiment. FIGS. 8A through 8C are diagrams comparing the recording unit according to the present embodiment with the comparative embodiments. FIG. 8A illustrates the recording unit 101 according to the present embodiment, and is the same as that illustrated in FIG. 7A. FIG. 8B is a diagram illustrating a recording unit according to a first comparative embodiment, and FIG. 8C is a diagram illustrating a recording unit according to a second comparative embodiment.

1. Recording Unit According to First Comparative Embodiment

A recording unit 120 according to the first comparative embodiment illustrated in FIG. 8B has a recording head 124L and recording head 124R provided separated by a distance W5 in the X direction, in the same way as with the recording unit 101 according to the present embodiment illustrated in FIG. 8A. Accordingly, the time required for recording all regions of the regions A1, A2, and A3 on the recording medium is the same for a case of using the recording unit 120 according to the first comparative embodiment and a case of using the recording unit according to the present embodiment are the same.

Now, the recording head 124L according to the first comparative embodiment has four discharge orifice rows 121C, 121M, 121Y, and 121K, in the order of discharge orifice row 121K that discharges black ink, discharge orifice row 121C that discharges cyan ink, discharge orifice row 121M that discharges magenta ink, and discharge orifice row 121Y that discharges yellow ink, from the left side in the X direction. On the other hand, the recording head 124R has four discharge orifice rows 122C, 122M, 122Y, and 122K, in the order of discharge orifice row 122K that discharges black ink, discharge orifice row 122C that discharges cyan ink, discharge orifice row 122M that discharges magenta ink, and discharge orifice row 122Y that discharges yellow ink, from the left side in the X direction. The four discharge orifice rows in the recording heads 124L and 124R are laid out separated from each other by a same distance d in the X direction, the same as in the present embodiment.

Next, the distance in the X direction between the two discharge orifice rows that discharge ink of each color according to the first comparative embodiment will be described in the same way as with the present embodiment. First, with regard to the cyan ink, the discharge orifice row 121C is situated the third from the right side in the X direction within the recording head 124L, and the discharge orifice row 122C is situated the second from the left side in the X direction within the recording head 124R. Accordingly, distance W_C2 in the X direction between the discharge orifice row 121C and discharge orifice row 122C is a distance that can be calculated by Expression (4-1).

$$W_C2=W5+2\times d+1\times d=W5+3d \quad \text{Expression (4-1)}$$

Now, the term "2×d" in Expression (4-1) is a term corresponding to the fact that there are two discharge orifice rows to the right of the discharge orifice row 121C in the X direction within the recording head 124L. The term "1×d" in Expression (4-1) is a term corresponding to the fact that there is one discharge orifice row to the left of the discharge orifice row 122C in the X direction within the recording head 124R.

In the same way, with regard to the magenta ink, the discharge orifice row 121M is situated the second from the right side in the X direction within the recording head 124L, and the discharge orifice row 122M is situated the third from the left side in the X direction within the recording head 124R. Accordingly, distance W_M2 in the X direction between the discharge orifice row 121M and discharge orifice row 122M is a distance that can be calculated by Expression (4-2).

$$W_M2=W5+1\times d+2\times d=W5+3d \quad \text{Expression (4-2)}$$

Also, with regard to the yellow ink, the discharge orifice row 121Y is situated the first from the right side in the X direction within the recording head 124L, and the discharge orifice row 122Y is situated the fourth from the left side in the X direction within the recording head 124R. Accordingly, distance W_Y2 in the X direction between the discharge orifice row 121Y and discharge orifice row 122Y is a distance that can be calculated by Expression (4-3).

$$W_Y2=W5+0\times d+3\times d=W5+3d \quad \text{Expression (4-3)}$$

Further, with regard to the black ink, the discharge orifice row 121K is situated the fourth from the right side in the X direction within the recording head 124L, and the discharge orifice row 122K is situated the first from the left side in the X direction within the recording head 124R. Accordingly, distance W_K2 in the X direction between the discharge orifice row 121K and discharge orifice row 122K is a distance that can be calculated by Expression (4-4).

$$W_K2=W5+3\times d+0\times d=W5+3d \quad \text{Expression (4-4)}$$

It can thus be seen from Expressions (4-1), (4-2), (4-3), and (4-4), that in the recording unit 120 used in the first comparative embodiment illustrated in FIG. 8B, the discharge orifice rows are arranged such the distance W_C2 between the discharge orifice rows 121C and 122C that discharge cyan ink, the distance W_M2 between the discharge orifice rows 121M and 122M that discharge magenta ink, the distance W_Y2 between the discharge orifice rows 121Y and 122Y that discharge yellow ink, and the distance W_K2 between the discharge orifice rows 121K and 122K that discharge black ink, are equal to each other (W5+3d).

It can be seen by comparing Expressions (3-1) and (4-1) that the distance W_C2 (W5+3d) between the discharge orifice rows 121C and 122C in the first comparative embodiment is longer than the distance W_C1 (W5+1d) between the discharge orifice rows 111C and 112C according to the present embodiment. Thus, the distance W_C2 (W5+3d) between the discharge orifice rows 121C and 122C in the first comparative embodiment may not be able to be made shorter, despite the cyan ink being an ink of which the permeation speed is high. Accordingly, there may be situations where the time difference from having applied cyan ink to region A2 on the recording medium from one discharge orifice row till applying cyan ink from the other discharge orifice row becomes longer, resulting in the above-described increase in concentration. This increase in concentration in recorded images may also occur with regard to magenta ink and yellow ink as well, due to the same reason, which can be seen by comparing Expressions (3-2) and (4-2), and Expressions (3-3) and (4-3). Thus, there is no increase in recording time in a case of using the recording unit 120 according to the first comparative example illustrated in FIG. 8B, but increase in concentration of ink of which the permeation speed is high may occur, as described earlier.

2. Recording Unit in Second Comparative Embodiment

A recording head 134L and a recording head 134R are provided separated by a distance W6 (W6<W5) in the X direction in a recording unit 130 according to the second comparative embodiment illustrated in FIG. 8C, unlike the recording unit 101 according to the present embodiment illustrated in FIG. 8A and the first comparative embodiment illustrated in FIG. 8B. Specifically, the recording unit 130 according to the second comparative embodiment has the recording head 134L and recording head 134R separated by the distance W6 so that the distance between recording head 134L and recording head 134R is shorter than the distance W5 by distance d (W6=W5−d). This suppresses the above-described increase in concentration due to the permeation speed.

The recording head 134L according to the second comparative embodiment has four discharge orifice rows 131C, 131M, 131Y, and 131K, in the order of discharge orifice row 131K that discharges black ink, discharge orifice row 131C that discharges cyan ink, discharge orifice row 131M that discharges magenta ink, and discharge orifice row 131Y that discharges yellow ink, from the left side in the X direction. On the other hand, the recording head 134R has four discharge orifice rows 132C, 132M, 132Y, and 132K, in the order of discharge orifice row 132K that discharges black ink, discharge orifice row 132C that discharges cyan ink, discharge orifice row 132M that discharges magenta ink, and discharge orifice row 132Y that discharges yellow ink, from the left side in the X direction. The four discharge orifice rows in the recording heads 134L and 134R are laid out separated from each other by a same distance d in the X direction, the same as in the present embodiment and the first comparative embodiment.

Next, the distance in the X direction between the two discharge orifice rows that discharge ink of each color according to the second comparative embodiment will be described in the same way as with the first comparative embodiment and the present embodiment. First, with regard to the cyan ink, the discharge orifice row 131C is situated the third from the right side in the X direction within the recording head 134L, and the discharge orifice row 132C is situated the second from the left side in the X direction within the recording head 134R. Accordingly, distance W_C3 in the X direction between the discharge orifice row 131C and discharge orifice row 132C is a distance that can be calculated by Expression (5-1).

$$W_C3=W6+2\times d+1\times d=(W5-d)+3d=W5+2d \quad \text{Expression (5-1)}$$

Now, the term "2×d" in Expression (5-1) is a term corresponding to the fact that there are two discharge orifice rows to the right of the discharge orifice row 131C in the X direction within the recording head 134L. The term "1×d" in Expression (5-1) is a term corresponding to the fact that there is one discharge orifice row to the left of the discharge orifice row 132C in the X direction within the recording head 134R. Further, the Expression is expanded as shown in Expression (5-1) due to the relationship of W6=W5−d, as described above.

Similarly, with regard to the magenta ink, the discharge orifice row 131M is situated the second from the right side in the X direction within the recording head 134L, and the discharge orifice row 132M is situated the third from the left side in the X direction within the recording head 134R. Accordingly, distance W_M3 in the X direction between the discharge orifice row 131M and discharge orifice row 132M is a distance that can be calculated by Expression (5-2).

$$W_M3=W6+1\times d+2\times d=(W5-d)+3d=W5+2d \quad \text{Expression (5-2)}$$

Also, with regard to the yellow ink, the discharge orifice row 131Y is situated the first from the right side in the X direction within the recording head 134L, and the discharge orifice row 132Y is situated the fourth from the left side in the X direction within the recording head 134R. Accordingly, distance W_Y3 in the X direction between the discharge orifice row 131Y and discharge orifice row 132Y is a distance that can be calculated by Expression (5-3).

$$W_Y3=W6+0\times d+3\times d=(W5-d)+3d=W5+2d \quad \text{Expression (5-3)}$$

Further, with regard to the black ink, the discharge orifice row 131K is situated the fourth from the right side in the X direction within the recording head 134L, and the discharge orifice row 132K is situated the first from the left side in the X direction within the recording head 134R. Accordingly, distance W_K3 in the X direction between the discharge orifice row 131K and discharge orifice row 132K is a distance that can be calculated by Expression (5-4).

$$W_K3=W6+3\times d+0\times d=(W5-d)+3d=W5+2d \quad \text{Expression (5-4)}$$

It can thus be seen from Expressions (5-1), (5-2), (5-3), and (5-4), that in the recording unit 130 used in the second comparative embodiment illustrated in FIG. 8C, the discharge orifice rows are arranged such the distance W_C3 between the discharge orifice rows 131C and 132C that discharge cyan ink, the distance W_M3 between the discharge orifice rows 131M and 132M that discharge magenta ink, the distance W_Y3 between the discharge orifice rows 131Y and 132Y that discharge yellow ink, and the distance W_K3 between the discharge orifice rows 131K and 132K that discharge black ink, are equal to each other (W5+2d).

It can be seen by comparing Expressions (3-1) and (5-1) that the distance W_C3 between the discharge orifice rows 131C and 132C in the second comparative embodiment and the distance W_C1 between the discharge orifice rows 111C and 112C according to the present embodiment are the same (W5+2d), and shorter than the distance W_C2 between discharge orifice rows 121C and 122C in the first comparative embodiment (W5+3d). Thus, the distance W_C3 between the discharge orifice rows 131C and 132C that discharge cyan ink of which the permeation speed is high can be made sufficiently short in the second comparative embodiment. When applying cyan ink from one of the discharge orifice rows to the region A2 on the recording medium and then applying cyan ink from the other discharge orifice row, application can be performed with less time difference than the first comparative embodiment, so the above-described increase in concentration due to permeation speed can be made less likely to occur during recording. This increase in concentration in recorded images can also be suppressed with regard to magenta ink and yellow ink as well, due to the same reason, which can be seen by comparing Expressions (3-2) and (5-2), and Expressions (3-3) and (5-3).

On the other hand, the distance between the recording head 134L and recording head 134R (W6) in the second comparative embodiment is made shorter than the distance between the recording head 102L and recording head 102R (W5) in the present embodiment, as mentioned earlier. Accordingly, in a case of using the recording unit 130 according to the second comparative embodiment, the scanning range that the recording unit needs to record the entire region of the recording medium in the X direction by a single scan is broader than in a case of using the recording unit 101 according to the present embodiment, so the amount of time taken to complete recording of the recording medium becomes longer. Thus, in a case of using the recording unit 130 according to the second comparative embodiment illustrated in FIG. 8C, increase in concentration with ink of which the permeation speed is fast does not readily occur, but recording time may increase.

As described above, using the recording unit 101 according to the present embodiment illustrated in FIG. 8A enables recording to be performed while suppressing increase in concertation due to different in permeation speed that occurs in a case of using the recording unit 120 illustrated in FIG. 8B, and also reducing recording time over a case of using the recording unit 130 illustrated in FIG. 8C.

Second Embodiment

An arrangement has been described in the first embodiment above, where the permeation speed is approximately the same among the color inks. An arrangement will be described in a second embodiment where the permeation speed differs among the color inks as well. Description of portions that are the same as in the above-described first embodiment will be omitted.

Ink Composition

Ink having the same composition as in the first embodiment will be used for the black ink and cyan ink in the present embodiment. On the other hand, ink having a different composition as in the first embodiment will be used for the magenta ink and yellow ink in the present embodiment. The compositions of the magenta ink and yellow ink used in the present embodiment will be described below in detail.

1. Magenta Ink

The magenta ink used in the present embodiment contains C.I. Acid Red 289, which is a dye, as a color material, the same as the magenta ink used in the first embodiment.

Specifically, the magenta ink used in the present embodiment is prepared by blending and agitating the following components, followed by filtration under pressure using a micro-filter.

| | |
|---|---|
| C.I. Acid Red 289 | 3% |
| Diethylene Glycol | 10% |
| Isopropyl Alcohol | 2% |
| Urea | 5% |
| Acetylenol EH (Manufactured by Kawaken Fine Chemicals Co., Ltd.) | 3% |
| Ion-exchanged water | 77% |

2. Yellow Ink

The yellow ink used in the present embodiment contains C.I. Direct Yellow 86, which is a dye, as a color material, the same as the yellow ink used in the first embodiment. Specifically, the yellow ink used in the present embodiment is prepared by blending and agitating the following components, followed by filtration under pressure using a micro-filter.

| | |
|---|---|
| C.I. Direct Yellow 86 | 3% |
| Diethylene Glycol | 10% |
| Isopropyl Alcohol | 2% |
| Urea | 5% |
| Acetylenol EH (Manufactured by Kawaken Fine Chemicals Co., Ltd.) | 5% |
| Ion-exchanged water | 75% |

It can be seen from above that the magenta ink and yellow ink used in the present embodiment contain more acetylenol EH, which is a surfactant, than the cyan ink used in the present embodiment. Specifically, the cyan ink used in the present embodiment contains 1% acetylenol EH, the magenta ink contains 3%, and the yellow ink contains 5%. On the other hand, the black ink contains no acetylenol EH, the same as in the first embodiment. Accordingly, regarding the ink used in the present embodiment, the permeation speed of the magenta ink is higher than the cyan ink, and the permeation speed of the yellow ink is higher than the magenta ink.

Accordingly, in a case of calculating the Ka values of ink used in the present embodiment, by the aforementioned Bristow's method, the Ka values of the inks are in the relationship shown in Expression (6).

*Ka* value of black ink<*Ka* value of cyan ink

*Ka* value of cyan ink<*Ka* value of magenta ink

*Ka* value of magenta ink<*Ka* value of yellow ink Expression (6)

The surface tension can also be used to evaluate the permeation speed, as described above. The surface tensions of the inks used in the present embodiment are in the relationship shown in Expression (7).

surface tension of black ink>surface tension of cyan ink surface tension of cyan ink>surface tension of magenta ink surface tension of magenta ink>surface tension of yellow ink Expression (7)

Details of Recording Unit 140

The higher the permeation speed as to the recording medium is, the greater the degree of concentration of the image will be in a case of applying ink to a certain region an earlier timing and then applying ink to the same region on the recording medium after a relatively long amount of time has elapsed. Accordingly, an arrangement is made in the present embodiment regarding the array of discharge orifice rows in the recording heads, where the higher the permeation speed of the ink is, the shorter the distance between discharge orifice rows that discharge that ink is.

Figure 9:
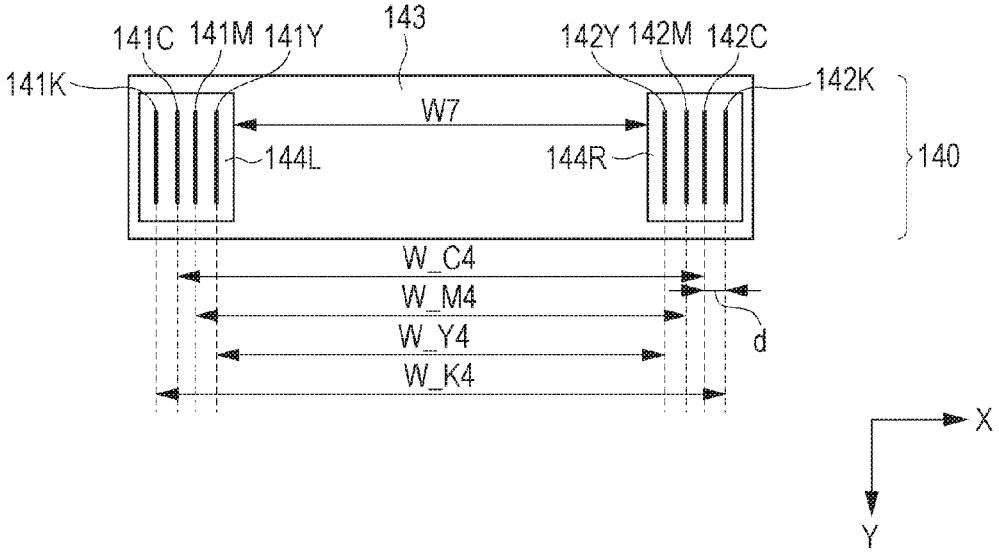
FIG. 9 is a diagram illustrating a recording unit used in an embodiment.

FIG. 9 is a diagram illustrating the recording unit 140 used in the present embodiment in detail, schematically illustrating the recording unit 140 from below in the vertical direction. The recording head 144L and the recording head 144R in the recording unit according to the present embodiment are separated by a distance W7 in the X direction. The recording head 144L has four discharge orifice rows 141C, 141M, 141Y, and 141K, in the order of discharge orifice row 141K that discharges black ink, discharge orifice row 141C that discharges cyan ink, discharge orifice row 141M that discharges magenta ink, and discharge orifice row 141Y that discharges yellow ink, from the left side in the X direction. On the other hand, the recording head 144R has four discharge orifice rows 142C, 142M, 142Y, and 142K, in the order of discharge orifice row 142Y that discharges yellow ink, discharge orifice row 142M that discharges magenta ink, discharge orifice row 142C that discharges cyan ink, and discharge orifice row 142K that discharges black ink, from the left side in the X direction. The four discharge orifice rows 141C, 141M, 141Y, and 141K in the recording head 144L are laid out separated from each other by a same distance d. In the same way, the four discharge orifice rows 142C, 142M, 142Y, and 142K in the recording head 144R are laid out separated from each other by the same distance d.

Now, the distance in the X direction between the two discharge orifice rows that discharge ink of each color according to the present embodiment will be described below in the same way as with the first embodiment. First, with regard to the cyan ink, the discharge orifice row 141C is situated the third from the right side in the X direction within the recording head 144L, and the discharge orifice row 142C is situated the third from the left side in the X direction within the recording head 144R. Accordingly, distance W_C4 in the X direction between the discharge orifice row 141C and discharge orifice row 142C is a distance that can be calculated by Expression (8-1).

$$W_C4=W7+2\times d+2\times d=W7+4d \quad \text{Expression (8-1)}$$

With regard to the magenta ink, the discharge orifice row 141M is situated the second from the right side in the X direction within the recording head 144L, and the discharge orifice row 142M is situated the second from the left side in the X direction within the recording head 144R. Accordingly, distance W_M4 in the X direction between the discharge orifice row 141M and discharge orifice row 142M is a distance that can be calculated by Expression (8-2).

$$W_M4=W7+1\times d+1\times d=W7+2d \quad \text{Expression (8-2)}$$

Also, with regard to the yellow ink, the discharge orifice row 141Y is situated the first from the right side in the X direction within the recording head 144L, and the discharge orifice row 142Y is situated the first from the left side in the X direction within the recording head 144R. Accordingly, distance W_Y4 in the X direction between the discharge orifice row 141Y and discharge orifice row 142Y is a distance that can be calculated by Expression (8-3).

$$W_Y4=W7+0\times d+0\times d=W7 \quad \text{Expression (8-3)}$$

Further, with regard to the black ink, the discharge orifice row 141K is situated the fourth from the right side in the X direction within the recording head 144L, and the discharge orifice row 142K is situated the fourth from the left side in the X direction within the recording head 144R. Accordingly, distance W_K4 in the X direction between the discharge orifice row 141K and discharge orifice row 142K is a distance that can be calculated by Expression (8-4).

$$W_K4=W7+3\times d+3\times d=W7+6d \quad \text{Expression (8-4)}$$

It can thus be seen from Expressions (8-1), (8-2), (8-3), and (8-4), that the distances between the discharge orifice rows corresponding to ink of each color are longer in the order of distance W_Y4 between the discharge orifice rows 141Y and 142Y discharging yellow ink (W7), distance W_M4 between the discharge orifice rows 141M and 142M discharging magenta ink (W7+2d), distance W_C4 between the discharge orifice rows 141C and 142C discharging cyan ink (W7+4d), and distance W_K4 between the discharge orifice rows 141K and 142K discharging black ink (W7+6d). That is to say, the discharge orifice rows corresponding to ink of the respective colors are arrayed such that the higher the permeation speed is, the shorter the distance between the discharge orifice rows discharging that ink is. Accordingly, recording time can be maximally shortened while suitably suppressing increase in concentration of recorded images generated more conspicuously the higher the permeation speed of the ink is according to the present embodiment.

Third Embodiment

An arrangement has been described in the above first and second embodiments where, regardless of the position in the region A2 in the X direction, quantization data is distributed to the two recording heads in such that the distribution ratio of quantization data to the recording head at the left side and the distribution ratio of quantization data to the recording head at the right side in the recording unit are equal in the left-right head distribution processing. As opposed to this, an arrangement will be described in a third embodiment where quantization data is distributed to the two recording heads such that the distribution ratio of quantization data to the recording head at the left side and the distribution ratio of quantization data to the recording head at the right side differ, in accordance with the position in the region A2 in the X direction. Description of portions that are the same as in the above-described first and second embodiments will be omitted.

In a case of using the distribution patterns illustrated in FIGS. 6A and 6B, the amount of discharge from each of the recording head 102L and recording head 102R abruptly switches at the boundary between region A1 and region A2, which can be seen in FIG. 6C. Specifically, region A1 is only recorded by the recording head 102L, while in region A2, the recording head 102L and recording head 102R each share 50% of the recording. In the same way, region A3 is recorded only by the recording head 102R, so the amount of discharge from each of the recording head 102L and recording head 102R changes abruptly at the boundary between region A2 and region A3 as well.

Now, if there is difference in discharge characteristics between the recording head 102L and recording head 102R, there may be irregularity in image quality at each of the boundary between region A1 and region A2 and boundary between region A2 and region A3. For example, a case will be considered of having recording heads 102L and 102R where the amount of discharge from the recording head 102L is greater than the amount of discharge from the recording head 102R. In this case, even if quantization data to discharge the same amount of ink to the regions A1, A2, and A3 is acquired, the amount of ink discharge as to region A1 will be greater than the amount of ink discharge to region A2, and the amount of ink discharge to region A2 will be greater than the amount of ink discharge to region A3. The change in the amount of ink discharge will abruptly occur between regions A1 and A2, and between regions A2 and A3. This abrupt change in the amount of ink discharge may be visually recognized as irregularity in image quality. Accordingly, the distribution patterns used for left-right recording head distribution processing in step S804 in the present embodiment are made to be different from those in the first embodiment. Thus, the above-described irregularity in image quality due to abrupt change in amount of discharge can be suppressed.

Figure 10A:
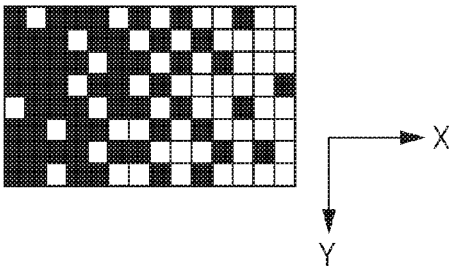
FIGS. 10A through 10C are diagrams for describing left-right head distribution processing according to an embodiment.
Figure 10B:
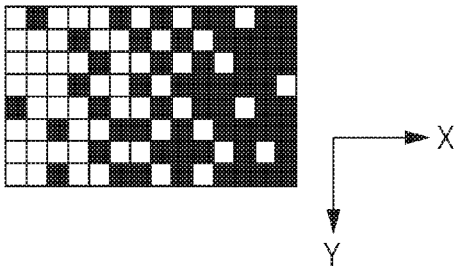
Figure 10C:
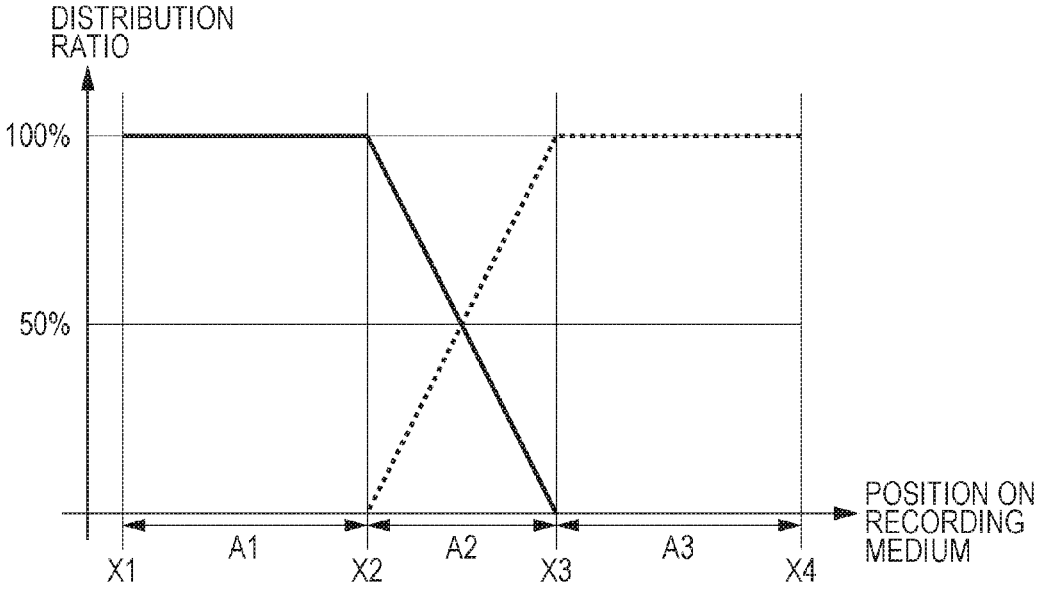

FIGS. 10A through 10C are schematic diagrams illustrating an example of distribution patterns used in the left-right head distribution processing in step S804 in the present embodiment. FIG. 10A is a diagram schematically illustrating a distribution pattern for distributing quantization data corresponding to region A2 on the recording medium, to the recording head 102L. FIG. 10B is a diagram schematically illustrating a distribution pattern for distributing this quantization data corresponding to the region A2 on the recording medium to the recording head 102R.

FIG. 10C is a diagram illustrating the distribution ratio to the recording head 102L, stipulated by the ratio of quantization data distributed to the recording head 102L, and the distribution ratio to the recording head 102R, stipulated by the ratio of quantization data distributed to the recording head 102R, as a result of having performed the left-right head distribution processing in step S804 according to the present embodiment. The solid lines in FIG. 10C represent the distribution ratio to the recording head 102L, and the dashed lines represent the distribution ratio to the recording head 102R.

In the distribution patterns illustrated in FIGS. 10A and 10B, the black pixels indicate pixels regarding which discharging of ink is permitted in a case where ink discharge is set by the quantization data. On the other hand, the white pixels indicate pixels regarding which discharging of ink is not permitted, even in a case where ink discharge is set by the quantization data.

It can be seen from FIGS. 10A and 10B that the distribution pattern corresponding to the recording head 102L and the distribution pattern corresponding to the recording head 102R, used in the present embodiment, have ink discharge permitted at mutually exclusive and complementary positions, in the same way as the distribution patterns used in the first embodiment illustrated in FIGS. 6A and 6B. Accordingly, left-right head distribution processing can be performed so that in a case where quantization data instructing discharge of ink to all pixels is acquired as the quantization data corresponding to the region A2, for example, ink is discharged just once, from either one or the other of the recording head 102L and the recording head 102R, at all pixels within this region.

It can also be seen from FIGS. 10A and 10B that the discharge patterns corresponding to the recording heads 102L and 102R, used in the present embodiment, have a different number of pixels regarding which discharge of ink is permitted, in accordance with the position in the X direction on the recording medium. In the distribution pattern corresponding to the recording head 102L illustrated in FIG. 10A, permission is set regarding ink discharge for each pixel such that the number of pixels regarding which discharge of ink is permitted gradationally decreases from the left side in the X direction toward the right side in the region A2 on the recording medium. On the other hand, in the distribution pattern corresponding to the recording head 102R illustrated in FIG. 10B, permission is set regarding ink discharge for each pixel such that the number of pixels regarding which discharge of ink is permitted gradationally increases from the left side in the X direction toward the right side in the region A2 on the recording medium.

Accordingly, in a case of using the distribution patterns illustrated in FIGS. 10A and 10B, the distribution ratio to the entire region of the recording medium in the X direction is as illustrated in FIG. 10C. No quantization data corresponding to the region A1 is distributed to the recording head 102R, so the distribution ratio to the recording head 102L in region A1 is 100%, in the same way as in the first embodiment. Also, no quantization data corresponding to the region A3 is distributed to the recording head 102L, so the distribution ratio to the recording head 102R in region A3 is 100%, in the same way as in the first embodiment.

In the region A2, the distribution pattern corresponding to the recording head 102L illustrated in FIG. 10A has ink discharge permission set so as to gradationally decrease from the left side toward the right side in the X direction, as described above. Accordingly, the distribution ratio to the recording head 102L gradationally decreases from the left side toward the right side in the X direction in region A2. On the other hand, the distribution pattern corresponding to the recording head 102R illustrated in FIG. 10B has ink discharge permission set so as to gradationally increase from the left side toward the right side in the X direction, as described above. Accordingly, the distribution ratio to the recording head 102L gradationally increases from the left side toward the right side in the X direction in region A2.

It can thus be seen from FIG. 10C that, although the distribution ratio of the recording head 102L and the distribution ratio of the recording head 102R differ depending on the position in the X direction within the region A2, the total thereof is 100% regardless of the position in the X direction. Accordingly, the discharge amount of ink as to the region A2 is not greatly different from the discharge amount desirable for the regions A1 and A3, in the present embodiment as well.

Further, it can be seen from FIG. 10C that the discharge amounts from the recording head 102L and recording head 102R are gradationally switched at the boundary between region A1 and region A2, and at the boundary between region A2 and region A3 in the present embodiment. For example, while the region A1 is recorded only using the recording head 102L, the amount of discharge from the recording head 102L gradually decreases in region A2 from the left edge portion in the right-side direction, and the amount of discharge from the recording head 102R gradationally increases. In the same way, while the region A3 is recorded only using the recording head 102R, the amount of discharge from the recording head 102R gradually decreases in region A2 from the right edge portion in the left-side direction, and the amount of discharge from the recording head 102L gradationally increases. Accordingly, even if there is difference in discharge characteristics between the recording head 102L and recording head 102R, abrupt change in discharge amount between region A1 and region A2 and between region A2 and region A3 can be suppressed, so irregularity in image quality can be reduced.

OTHER EMBODIMENTS

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

Although an arrangement has been described in the above embodiments where black ink is used that does not contain a surfactant and permeation speed is delayed, black ink may be used that contains more surfactant than the color ink so permeation speed is increased. In this case, the recording unit may be provided such that the distance between discharge orifice rows discharging black ink is shorter than the distance between discharge orifice rows discharging color ink.

Although an arrangement has been described in the second embodiment where the amount of surfactant contained surfactant is increased in the order of cyan ink, magenta ink, and yellow ink, and the permeation speed is increased, and the distance between discharge orifice rows discharging yellow ink is made to be shorter than the distance between the discharge orifice rows discharging magenta ink, and the distance between discharge orifice rows discharging magenta ink is made to be shorter than the distance between the discharge orifice rows discharging cyan ink, other arrangements may be made. Even in a case where the amounts of surfactant contained in the cyan ink, magenta ink, and yellow ink differ, the distance between discharge orifice rows may be the same among the cyan ink, magenta ink, and yellow ink as with the recording unit illustrated in FIGS. 7A and 7B, as long as there is no great difference in permeation speeds of the inks.

Although a case of using cyan ink, magenta ink, yellow ink, and black ink has been described in the above embodiments, this is not restricted to using inks of different colors. Advantages of the embodiments can be yielded in a case of using multiple types of ink that differ from each other in permeation speed. For example, in a case where the composition of a first black ink and a second black ink differ, and the permeation speed of the second black ink is higher than the first black ink, the distance between discharge orifice rows that discharge the second black ink can be made shorter than the distance between discharge orifice rows that discharge the first black ink.

Description has been made in the embodiments above regarding a case of using cyan ink, magenta ink, yellow ink, and black ink, including dye as a color material. However, ink containing pigment may be used as well. Generally, ink containing pigment does not readily permeate the recording medium, or does not permeate at all, so the same advantages can be obtained as the embodiments by considering this to be an ink with low permeation speed in the embodiments.

Although description has been made in the above embodiments regarding a recording unit where the left recording head and right recording head are disposed separated by a certain distance, it is preferable that this separation distance (W5, W7) is at least longer than the distance d between discharge orifice rows in the recording heads. Since the longer the distance between recording heads is, the more the recording time can be reduced, so the recording heads are preferably separated in practice by a distance that yields a desired recording time.

Although an arrangement has been described in the above embodiments where one discharge orifice row is configured by a single row of multiple discharge orifices that discharge ink of the same type being arrayed in the Y direction, other arrangements may be made as well. For example, an arrangement may be made where one discharge orifice row is configured by two rows of multiple discharge orifices that discharge ink of the same type being arrayed in the Y direction, with the two rows being positionally staggered in the Y direction such that the discharge orifices of one row can discharge ink between discharge orifices of the other row. In this case, the above-described distance between the discharge orifice rows can be based on the center position in the X direction between the two rows making up each discharge orifice row.

Although description has been made in the above embodiments regarding using a recording unit made up of two different recording heads and a holding part holding the recording head as a recording unit, other arrangements may be made. That is to say, advantages the same as those of the embodiments can be yielded by an arrangement using a recording unit having a first recording part and a second recording part each having discharge orifice rows discharging two types of ink having different permeation speeds, with the first and second recording parts being disposed with a certain distance therebetween in the X direction. For example, advantages the same as those of the embodiments can be yielded by an arrangement using a recording unit that does not have a holding part and the first recording part and second recording part are provided within a single recording head.

According to the recording device of the disclosure, deterioration in image quality can be suppressed without increasing the relative movement distance of the recording unit as to the recording medium.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-120101 filed Jun. 16, 2016, which is hereby incorporated by reference herein in its entirety.

What is claimed is:

1. A recording device comprising:

a recording unit including a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction, and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction, the first recording part and the second recording part being disposed separately from each other in an intersecting direction that intersects the predetermined direction;

a scanning unit configured to perform recording scanning by moving the recording unit in the intersecting direction; and a recording control unit configured to, in a same recording scan by the scanning unit, perform recording of a first region on the recording medium in the intersecting direction, which is on one edge side of the recording medium, by only the first recording part, perform recording of a second region in the intersecting direction, which is on the other edge side of the recording medium, by only the second recording part, and perform recording of a third region on the recording medium between the first region and the second region in the intersecting direction, by both the first recording part and the second recording part, wherein the first ink has a higher permeation speed as to the recording medium than the permeation speed of the second ink as to the recording medium, and wherein a distance between the first discharge orifice row and the third discharge orifice row in the intersecting direction is a first distance, and a distance between the second discharge orifice row and the fourth discharge orifice row in the intersecting direction is a second distance that is longer than the first distance.

2. The recording device according to claim 1, wherein the first discharge orifice row and the third discharge orifice row are each situated between the second discharge orifice row and the fourth discharge orifice row in the intersecting direction.

3. The recording device according to claim 1, wherein the first recording part further includes a fifth discharge orifice row where a plurality of discharge orifices that discharge a third ink, that is of a different type from the first and second inks, and that has a lower permeation speed as to the recording medium than the second ink, are arrayed in the predetermined direction, wherein the second recording part further includes a sixth discharge orifice row where a plurality of discharge orifices that discharge the third ink are arrayed in the predetermined direction, and wherein a distance between the fifth discharge orifice row and the sixth discharge orifice row in the intersecting direction is a third distance that is longer than the second distance.

4. The recording device according to claim 3, wherein the second discharge orifice row and the fourth discharge orifice row are each situated between the fifth discharge orifice row and the sixth discharge orifice row in the intersecting direction.

5. The recording device according to claim 1, wherein the scanning unit scans the recording unit such that the time between a timing at which the first ink is discharged from the first discharge orifice row as to a predetermined position within the third region in the intersecting direction and a timing at which the first ink is discharged from the third discharge orifice row as to the predetermined position, is shorter than the time between a timing at which the second ink is discharged from the second discharge orifice row as to the predetermined position and a timing at which the second ink is discharged from the fourth discharge orifice row as to the predetermined position.

6. The recording device according to claim 1, further comprising:

an acquisition unit configured to acquire image data corresponding to images recorded in the first, second, and third regions;

a distribution unit configured to generate the image data corresponding to an image to be recorded in the third region by the first recording part and the image data corresponding to an image to be recorded in the third region by the second recording part, by distributing the image data corresponding to an image to be recorded in the third region to the first recording part and the second recording part; and a generating unit configured to generate first recording data used in recording by the first recording part and second recording data used in recording by the second recording part, based on the image data corresponding to the image to be recorded in the first and second regions that has been acquired by the acquisition unit, and the image data corresponding to the an image to be recorded in the third region by the first and second recording parts that has been generated by the distribution unit, wherein the recording control unit causes the first recording part to discharge the first and second ink to the first region and the third region, in accordance with the first recording data, and causes the second recording part to discharge the first and second ink to the second region and the third region, in accordance with the second recording data, while preforming scanning by the scanning unit.

7. The recording device according to claim 6, wherein the distribution unit distributes the image data to the first recording part and the second recording part such that image data corresponding to an image to be recorded at a first position in the third region in the intersecting direction by the first recording part is greater than image data corresponding to an image to be recorded to the first position from the second recording part, and image data corresponding to an image to be recorded at a second position in the third region in the intersecting direction, that is closer to the second region than the first position, by the first recording part, is smaller than image data corresponding to an image to be recorded to the second position from the second recording part.

8. The recording device according to claim 1, wherein an amount of surfactant contained in the first ink is greater than an amount of surfactant contained in the second ink.

9. The recording device according to claim 8, wherein the second ink contains no surfactant.

10. The recording device according to claim 1, wherein the first ink is color ink, and the second ink is black ink.

11. The recording device according to claim 1, wherein the first recording part and the second recording part are different recording heads, and wherein the recording unit further includes a holding part configured to hold the first recording part and the second recording part.

12. The recording device according to claim 1, wherein the first recording part and the second recording part of the recording unit are disposed at the same position as each other in the predetermined direction.

13. A recording device comprising:

a recording unit including a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction, and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction, the first recording part and the second recording part being disposed separately from each other in an intersecting direction that intersects the predetermined direction;

a scanning unit configured to perform recording scanning by moving the recording unit in the intersecting direction; and a recording control unit configured to, in a same recording scan by the scanning unit, perform recording of a first region on the recording medium in the intersecting direction, which is on one edge side of the recording medium, by only the first recording part, perform recording of a second region on the recording medium in the intersecting direction, which is on the other edge side of the recording medium, by only the second recording part, and perform recording of a third region between the first region and the second region in the intersecting direction, by both the first recording part and the second recording part, wherein the first ink has a lower surface tension than the surface tension of the second ink, and wherein a distance between the first discharge orifice row and the third discharge orifice row in the intersecting direction is a first distance, and a distance between the second discharge orifice row and the fourth discharge orifice row in the intersecting direction is a second distance that is longer than the first distance.

14. A recording method of performing recording using a recording unit including a recording unit including a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction, and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction, the first recording part and the second recording part being disposed separately from each other in an intersecting direction that intersects the predetermined direction, the method comprising:

performing recording scanning by moving the recording unit in the intersecting direction; and controlling recording operations to, in a same recording scan by the scanning unit, perform recording of a first region on the recording medium in the intersecting direction, which is on one edge side of the recording medium, by only the first recording part, perform recording of a second region in the intersecting direction, which is on the other edge side of the recording medium, by only the second recording part, and perform recording of a third region on the recording medium between the first region and the second region in the intersecting direction, by both the first recording part and the second recording part, wherein the first ink has a higher permeation speed as to the recording medium than the permeation speed of the second ink as to the recording medium, and wherein a distance between the first discharge orifice row and the third discharge orifice row in the intersecting direction is a first distance, and a distance between the second discharge orifice row and the fourth discharge orifice row in the intersecting direction is a second distance that is longer than the first distance.

15. A recording unit comprising:

a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction; and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction, wherein the first recording part and the second recording part being disposed separately from each other in an intersecting direction that intersects the predetermined direction, wherein the first ink has a higher permeation speed as to the recording medium than the permeation speed of the second ink as to the recording medium, and wherein a distance between the first discharge orifice row and the third discharge orifice row in the intersecting direction is a first distance, and a distance between the second discharge orifice row and the fourth discharge orifice row in the intersecting direction is a second distance that is longer than the first distance.

16. The recording unit according to claim 15, wherein the first recording part and the second recording part are different recording heads, and wherein the recording unit further includes a holding part configured to hold the first recording part and the second recording part.

17. A recording unit comprising:

a first recording part where there are provided at least a first discharge orifice row where a plurality of discharge orifices that discharge a first ink are arrayed in a predetermined direction, and a second discharge orifice row where a plurality of discharge orifices that discharge a second ink of a different type from the first ink are arrayed in the predetermined direction; and a second recording part where there are provided at least a third discharge orifice row where a plurality of discharge orifices that discharge the first ink are arrayed in the predetermined direction, and a fourth discharge orifice row where a plurality of discharge orifices that discharge the second ink are arrayed in the predetermined direction, wherein the first recording part and the second recording part being disposed separately from each other in an intersecting direction that intersects the predetermined direction, wherein the first ink has a lower surface tension than the surface tension of the second ink, and wherein a distance between the first discharge orifice row and the third discharge orifice row in the intersecting direction is a first distance, and a distance between the second discharge orifice row and the fourth discharge orifice row in the intersecting direction is a second distance that is longer than the first distance.

18. The recording unit according to claim 17, wherein the first recording part and the second recording part are different recording heads, and wherein the recording unit further includes a holding part configured to hold the first recording part and the second recording part.

* * * * *